US012612276B2

(12) United States Patent
Koike et al.

(10) Patent No.: US 12,612,276 B2
(45) Date of Patent: Apr. 28, 2026

(54) SHEET TRANSPORTING DEVICE AND IMAGE FORMING APPARATUS

(71) Applicant: FUJIFILM Business Innovation Corp., Tokyo (JP)

(72) Inventors: Yoshinori Koike, Kanagawa (JP); Hirotake Eguchi, Kanagawa (JP); Yasunobu Goto, Kanagawa (JP); Kiyoshi Watanabe, Kanagawa (JP); Yuki Kawazoe, Kanagawa (JP); Shuhei Kobori, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 374 days.

(21) Appl. No.: 18/179,364

(22) Filed: Mar. 7, 2023

(65) Prior Publication Data

US 2024/0101378 A1 Mar. 28, 2024

(30) Foreign Application Priority Data

Sep. 27, 2022 (JP) ..... 2022-154046

(51) Int. Cl.
*B65H 9/00* (2006.01)
*B65H 7/06* (2006.01)

(52) U.S. Cl.
CPC ..... *B65H 9/002* (2013.01); *B65H 7/06* (2013.01); *B65H 2511/11* (2013.01); *B65H 2511/13* (2013.01); *B65H 2513/11* (2013.01)

(58) Field of Classification Search
CPC . B65H 9/002; B65H 2511/11; B65H 2511/13; B65H 2511/24; B65H 2513/11; B65H 2601/272; B65H 2301/331
USPC ..... 271/184
See application file for complete search history.

(56) References Cited

U.S. PATENT DOCUMENTS

| | | | | |
|---|---|---|---|---|
| 7,753,370 | B2 | 7/2010 | Inoue | |
| 8,584,832 | B2 * | 11/2013 | Depoi | B65H 5/062 198/379 |
| 9,463,941 | B2 * | 10/2016 | Mori | B65H 9/06 |
| 9,932,189 | B2 * | 4/2018 | Nakamura | G03G 15/55 |
| 9,938,101 | B2 * | 4/2018 | Watanabe | B65H 5/062 |
| 10,800,625 | B2 * | 10/2020 | Bhide | B65H 7/08 |

FOREIGN PATENT DOCUMENTS

| | | |
|---|---|---|
| JP | 2008001473 | 1/2008 |
| JP | 2012166956 | 9/2012 |

* cited by examiner

*Primary Examiner* — Leslie A Nicholson, III
(74) *Attorney, Agent, or Firm* — JCIPRNET

(57) ABSTRACT

A sheet transporting device includes: a skew correcting component configured to correct any skew of a sheet by executing speed-gap driving in which first and second transporting components that are arranged at respective positions in a direction intersecting a direction of sheet transport are driven for a predetermined time period with a speed gap between the first and second transporting components; and a changing component configured to change, with reference to a characteristic relevant to sheet transport, a state of the speed-gap driving of the skew correcting component.

17 Claims, 17 Drawing Sheets

FIG. 18

| BASIS WEIGHT (gsm) | β VALUE |
|---|---|
| < 63 | 0.5 |
| ≥ 63 BUT < 105 | 0.8 |
| ≥ 105 BUT < 220 | 1 |
| ≥ 220 BUT < 300 | 1.5 |
| ≥ 300 BUT < 350 | 2 |
| ≥ 350 | 3 |

FIG. 19

| PAPER LENGTH (mm) | γ VALUE |
|---|---|
| < 210 | 0.5 |
| ≥ 210 BUT < 420 | 0.8 |
| ≥ 420 BUT < 488 | 1 |
| ≥ 488 BUT < 600 | 1.1 |
| ≥ 600 BUT < 800 | 1.2 |
| ≥ 800 BUT < 1000 | 1.3 |
| ≥ 1000 BUT < 1200 | 1.4 |
| ≥ 1200 | 1.5 |

FIG. 20

| PAPER TYPE | η VALUE |
|---|---|
| PLAIN PAPER | 1 |
| COATED PAPER | 1.2 |
| EMBOSSED PAPER | 1.2 |
| FILM | 1.2 |

FIG. 21

ε VALUE = CORRECTION VALUE FOR AMBIENT TEMPERATURE × CORRECTION VALUE FOR AMBIENT HUMIDITY

| | | |
|---|---|---|
| AMBIENT TEMPERATURE (°C) | < 10 | 1.1 |
| | ≥ 10 BUT < 20 | 1 |
| | ≥ 20 BUT < 30 | 1.1 |
| | ≥ 30 | 1.2 |
| AMBIENT HUMIDITY (RH%) | < 5 | 1.1 |
| | ≥ 5 BUT < 50 | 1 |
| | ≥ 50 TO 100 | 1.1 |

SHEET TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2022-154046 filed Sep. 27, 2022.

BACKGROUND

(i) Technical Field

The present disclosure relates to a sheet transporting device and an image forming apparatus.

(ii) Related Art

Hitherto proposed techniques relating to sheet transporting devices include those disclosed by Japanese Unexamined Patent Application Publication No. 2008-001473 and Japanese Unexamined Patent Application Publication No. 2012-166956, for example.

According to Japanese Unexamined Patent Application Publication No. 2008-001473, a sheet transporting device includes a skew correcting unit configured to correct any skew of a sheet by rotating the sheet while transporting the sheet; a lateral-registration correcting unit provided on the downstream side relative to the skew correcting unit and being movable in a direction orthogonal to the direction of sheet transport, the lateral-registration correcting unit being configured to correct the position of the sheet in the direction orthogonal to the direction of sheet transport; and a sheet-transport assisting unit provided on the upstream side relative to the skew correcting unit and being movable in the direction orthogonal to the direction of sheet transport. After any skew of the sheet is corrected by the skew correcting unit, the sheet is moved for position correction by the lateral-registration correcting unit in the direction orthogonal to the direction of sheet transport while the sheet-transport assisting unit operating synchronously with the lateral-registration correcting unit is moved in the direction in which the lateral-registration correcting unit is moved.

According to Japanese Unexamined Patent Application Publication No. 2012-166956, the skew of the sheet is corrected as follows: if the amount of sheet skew detected by a detecting unit is smaller than or equal to a predetermined value, the speed of sheet transport is varied between a first roller and a second roller such that the difference in the speed of sheet transport between the first roller and the second roller increases with the increase in the amount of detected sheet skew; if the amount of sheet skew detected by the detecting unit is greater than the predetermined value, the speeds of sheet transport by the first roller and the second roller are made smaller than those for the sheet skew of an amount smaller than or equal to the predetermined value, whereby the difference in the speed of sheet transport between the first roller and the second roller is reduced.

SUMMARY

Aspects of non-limiting embodiments of the present disclosure relate to making the accuracy in the correction of sheet skew higher than in a configuration including no changing component configured to change the state of speed-gap driving of a skew correcting component with reference to a characteristic relevant to sheet transport.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet transporting device including: a skew correcting component configured to correct any skew of a sheet by executing speed-gap driving in which first and second transporting components that are arranged at respective positions in a direction intersecting a direction of sheet transport are driven for a predetermined time period with a speed gap between the first and second transporting components; and a changing component configured to change, with reference to a characteristic relevant to sheet transport, a state of the speed-gap driving of the skew correcting component.

BRIEF DESCRIPTION OF THE DRAWINGS

Exemplary embodiments of the present disclosure will be described in detail based on the following figures, wherein:

FIG. 18 is a table summarizing correction factors for different basis weights of recording paper;

FIG. 19 is a table summarizing correction factors for different lengths of recording paper;

FIG. 20 is a table summarizing correction factors for different types of recording paper; and FIG. 21 is a table summarizing correction factors for different environmental conditions.

DETAILED DESCRIPTION

First Exemplary Embodiment

Figure 1:
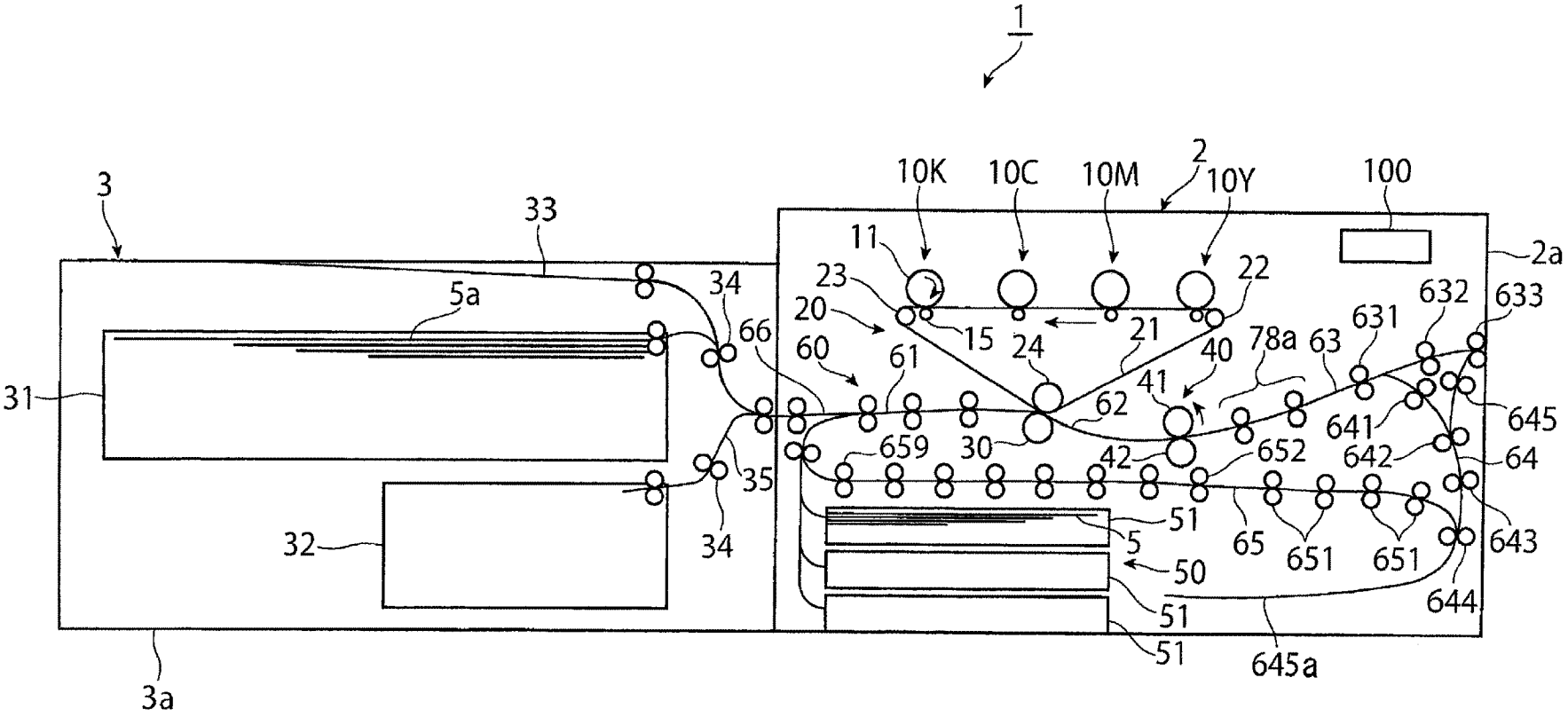
FIG. 1 illustrates an overall configuration of an image forming apparatus to which a sheet transporting device according to a first exemplary embodiment of the present disclosure is applied.

FIG. 1 illustrates the entirety of an image forming apparatus 1 to which a sheet transporting device according to a first exemplary embodiment of the present disclosure is applied.

Overall Configuration of Image Forming Apparatus

The image forming apparatus 1 according to the first exemplary embodiment is configured as, for example, a color printer. As illustrated in FIG. 1, the image forming apparatus 1 includes an image output device 2, which is configured to form (output) a full-color image composed of different colors such as yellow (Y), magenta (M), cyan (C), and black (K) on recording paper 5 serving an exemplary recording medium (sheet); and a paper feeding device 3, which is a stand-alone device configured to feed long-size recording paper (hereinafter referred to as "long-size paper") or the like to the image output device 2. The paper feeding device 3 is located outside the image output device 2 and adjoins the image output device 2.

The image output device 2 includes a plurality of imaging devices 10, which are exemplary image forming component and are configured to form toner images developed with toners contained in developers; an intermediate transfer device 20, which is configured to receive the toner images formed by the imaging devices 10 and transport the toner images to a second-transfer position, where the toner images are eventually transferred to the recording paper 5 as an exemplary recording medium (sheet) in a second-transfer process; a paper feeding device 50, which contains predetermined pieces of recording paper 5 to be supplied to the second-transfer position defined in the intermediate transfer device 20 and is configured to feed each of the pieces of recording paper 5; a fixing device 40, which is configured to fix the toner images transferred to the recording paper 5 in the second-transfer process performed by the intermediate transfer device 20; and a paper transporting device 60, which is an exemplary sheet transporting device (sheet transporting component) and is configured to receive the recording paper 5 from the paper feeding device 50 and transport the recording paper 5 along a predetermined transport path. The image output device 2 has a device body 2*a*. The device body 2*a* includes supporting members, exterior coverings, and so forth. In FIG. 1, transport paths along which the recording paper 5 is to be transported in the device body 2*a* and other locations are represented by solid lines.

The imaging devices 10 are four imaging devices 10Y, 10M, 10C, and 10K, which are configured to exclusively form respective toner images in four respective colors of yellow (Y), magenta (M), cyan (C), and black (K). The four imaging devices 10 (Y, M, C, and K) are arranged in a line and at predetermined intervals in the horizontal direction in the device body 2*a*.

The four imaging devices 10 each include, for example, a photoconductor drum 11, and imaging elements (not illustrated) that are provided around the photoconductor drum 11 and cooperate to form a toner image in a corresponding one of the predetermined colors on the surface of the photoconductor drum 11, whereby the imaging devices 10 electrophotographically form respective images in the respective colors of yellow (Y), magenta (M), cyan (C), and black (K) on the surfaces of the respective photoconductor drums 11. The four imaging devices 10 are not limited to devices employing an electrophotographic scheme to form images and may be devices employing any other scheme such as an inkjet recording scheme or electrostatic recording scheme to form images in respective colors such as yellow (Y), magenta (M), cyan (C), and black (K). If the imaging devices 10 employ an inkjet recording scheme to form images, the intermediate transfer device 20 is omitted; that is, the imaging devices 10 form images directly on the recording paper 5. In such a case, imaging devices configured to form images in the respective colors such as yellow (Y), magenta (M), cyan (C), and black (K) by an inkjet recording scheme are aligned in the direction of transport of the recording paper 5.

As illustrated in FIG. 1, the intermediate transfer device 20 is located below the imaging devices 10 (Y, M, C, and K) for yellow (Y), magenta (M), cyan (C), and black (K) in the vertical direction. The intermediate transfer device 20 includes an intermediate transfer belt 21, which is to be rotated in the direction of the arrow in such a manner as to pass through first-transfer positions defined between the photoconductor drums 11 and respective first-transfer devices 15 (first-transfer rolls); a plurality of belt supporting rolls 22 to 24, which support the intermediate transfer belt 21 from the inner side such that the intermediate transfer belt 21 is retained in a predetermined position while being allowed to rotate; and a second-transfer device 30, which faces the outer peripheral surface (an image-carrying surface) of the intermediate transfer belt 21 at a position across from the belt supporting roll 24 and is configured to transfer a set of toner images from the intermediate transfer belt 21 to the recording paper 5 in the second-transfer process.

The fixing device 40 has a housing (not illustrated) having an introduction port and a discharge port for the recording paper 5 and that houses elements including the following: a heating rotary member 41, which is in the form of a roll or belt and is configured to rotate in the direction of the arrow and to be heated by a heating component such that the surface thereof is kept at a predetermined temperature; and a pressing rotary member 42, which is in the form of a belt or roll and is configured to rotate by being in contact with the heating rotary member 41 with a predetermined pressure over an area extending substantially in the axial direction of the heating rotary member 41. In the fixing device 40, the contact area where the heating rotary member 41 and the pressing rotary member 42 are in contact with each other serves as a fixing part, where a predetermined fixing process (heating and pressing) is to be performed.

As illustrated in FIG. 1, the paper feeding device 50 is located below the intermediate transfer device 20 and the second-transfer device 30. The paper feeding device 50 includes a plurality of paper containers 51 (or a single paper container 51), which each contain a stack of pieces of recording paper 5 that are of one predetermined size, kind, or the like; and delivering devices (not illustrated), which are each configured to deliver the pieces of recording paper 5 one by one from a corresponding one of the paper containers 51. The paper containers 51 are each drawable from, for example, the front face of the device body 2*a* (the face toward which the user who is operating the image output device 2 faces).

The stand-alone paper feeding device 3 includes a paper container 31 and a large-capacity paper container 32. The paper container 31 contains a stack of pieces of long-size paper 5*a*. The long-size paper 5*a* has a greater length in a direction of paper feeding and/or a direction intersecting the direction of paper feeding than the recording paper 5 of size A3, which is the largest one of standard sizes typically handled by the image forming apparatus 1. The large-capacity paper container 32 is capable of containing a greater number of pieces of recording paper 5 of a standard size than the paper containers 51, which are typically used. The paper feeding device 3 further includes a paper tray 33, which is provided at the top of a device body 3*a* and is intended for manual feeding of the long-size paper 5*a* or the like.

The paper transporting device 60 includes a paper feeding path 61, along which recording paper 5 fed from the paper feeding device 50 is transported to the second-transfer position; an intermediate transport path 62, along which the recording paper 5 having received a set of toner images at the second-transfer position in the second-transfer process is transported to the fixing device 40; an outputting transport path 63, along which the recording paper 5 having the set of toner images fixed by the fixing device 40 is transported to a paper receiving member (not illustrated); a reversal transport path 64, along which the recording paper 5 having the set of toner images fixed by the fixing device 40 is reversed before being outputted to the paper receiving member; and a duplex transport path 65, along which the recording paper 5 reversed in the reversal transport path 64 is transported to the paper feeding path 61 again for an image forming process to be performed on the other side of the recording paper 5. Details of the paper transporting device 60 will be described separately below.

The stand-alone paper feeding device 3 includes a paper feeding path 35, which is provided with pairs of paper transporting rolls 34. The long-size paper 5*a* or recording paper 5 that is fed from any of the paper container 31, the large-capacity paper container 32, and the manual-feeding paper tray 33 is transported by the pair of paper transporting rolls 34 to an external-paper feeding path 66, which is provided in the image output device 2.

An overall operation of the image forming apparatus 1 inclusive of the paper feeding device 3 is controlled by a control device 100, illustrated in FIG. 1. To control the overall operation of the image forming apparatus 1 inclusive of the paper feeding device 3, the control device 100 acknowledges the size or kind of the recording paper 5 informed of by the user's instruction or the like and controls transporting operations including an operation of correcting any skew of the recording paper 5.

Basic Operation of Image Forming Apparatus

A basic image forming operation performed by the image forming apparatus 1 will now be described.

The following description relates to an image forming operation in which a full-color image composed of toner images having the four respective colors (Y, M, C, and K) is formed by using the four imaging devices 10 (Y, M, C, and K).

When the control device 100 of the image forming apparatus 1 receives a command that requests an image forming operation (printing operation), the control device 100 activates the four imaging devices 10 (Y, M, C, and K), the intermediate transfer device 20, the second-transfer device 30, the fixing device 40, the paper feeding device 50, the paper transporting device 60, and other relevant devices.

First, in the imaging devices 10 (Y, M, C, and K), toner images in the respective colors of yellow (Y), magenta (M), cyan (C), and black (K) are formed on the respective photoconductor drums 11. The toner images in the respective colors thus formed on the photoconductor drums 11 of the imaging devices 10 (Y, M, C, and K) are carried to the respective first-transfer positions, where the first-transfer devices 15 perform a first-transfer process, in which the toner images in the respective colors are sequentially superposed one on top of another on the intermediate transfer belt 21 of the intermediate transfer device 20 that is rotating in the direction of the arrow.

Subsequently, in the intermediate transfer device 20, the intermediate transfer belt 21 having received the set of toner images in the first-transfer process rotates to transport the set of toner images to the second-transfer position. Meanwhile, in the paper feeding device 50, a predetermined piece of recording paper 5 is fed into the paper feeding path 61 synchronously with the imaging process. In the paper feeding path 61, the piece of recording paper 5 is supplied to the second-transfer position synchronously with the timing of transfer.

At the second-transfer position in the intermediate transfer device 20, the second-transfer device 30 performs the second-transfer process in which the set of toner images on the intermediate transfer belt 21 is transferred to the piece of recording paper 5. The piece of recording paper 5 now having the set of toner images received in the second-transfer process is released from the intermediate transfer belt 21 and the second-transfer device 30 and is transported to the fixing device 40. In the fixing device 40, the piece of recording paper 5 having undergone the second-transfer process is made to pass through the fixing part defined between the heating rotary member 41 and the pressing rotary member 42 that are rotating, whereby the set of unfixed toner images are fixed to the piece of recording paper 5 through the predetermined fixing process (heating and pressing). The piece of recording paper 5 having undergone the fixing process is transported along the outputting transport path 63 to, for example, the paper receiving member (not illustrated) provided on the outside of the image output device 2.

If an image is to be formed on each of the two sides of the piece of recording paper 5, the piece of recording paper 5 having an image on one side thereof is not immediately discharged to the paper receiving member (not illustrated) through the outputting transport path 63 but is redirected toward the reversal transport path 64 by a redirecting component (not illustrated). As the piece of recording paper 5 is transported along the reversal transport path 64, the front and back sides of the piece of recording paper 5 are reversed. Then, the piece of recording paper 5 is transported along the duplex transport path 65 to the paper feeding path 61 again for the operation of forming an image on the back side of the piece of recording paper 5.

If an image is to be formed on one side or each of the two sides of a piece of long-size paper 5*a* or the like that is fed from the external paper feeding device 3, the paper feeding device 3 operates as follows: a piece of recording paper 5, such as long-size paper 5*a*, is fed to the paper feeding path 35 synchronously with the imaging process and is transported along the paper feeding path 35 to the external-paper feeding path 66 provided in the image output device 2.

Through the above series of processes, a piece of recording paper 5 having a full-color image formed as a combination of toner images in the four respective colors is obtained.

Configuration of Sheet Transporting Device

Figure 2:
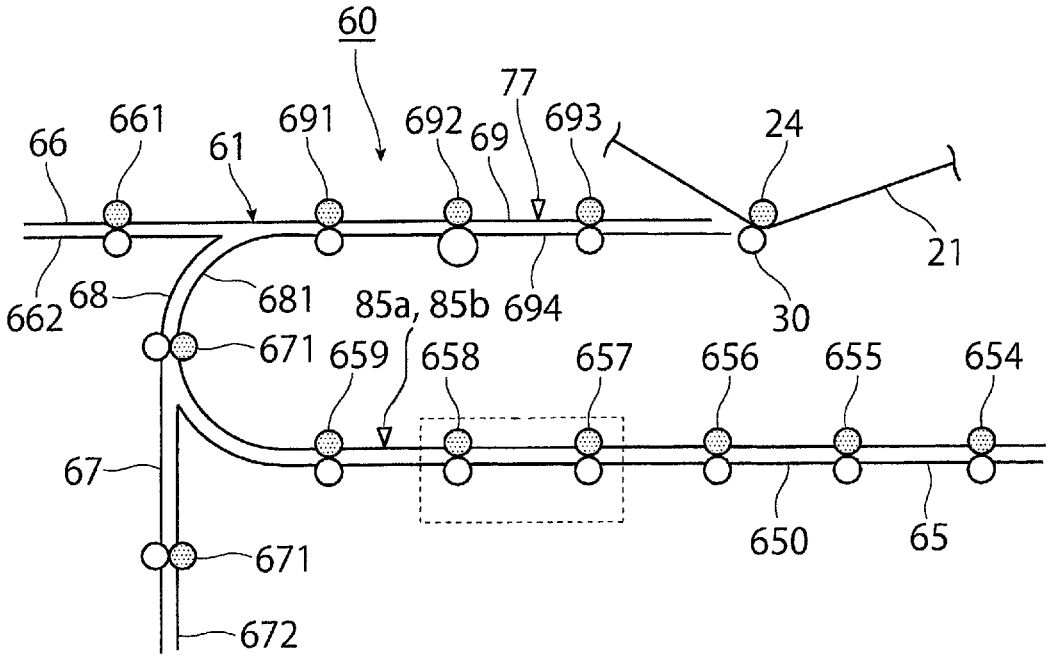
FIG. 2 illustrates a configuration of a relevant part of a paper transporting device serving as an exemplary sheet transporting device according to the first exemplary embodiment of the present disclosure.

FIGS. 1 and 2 illustrate the configuration of the image forming apparatus 1 to which the paper transporting device 60 serving as an exemplary sheet transporting device according to the first exemplary embodiment of the present disclosure is applied.

The paper transporting device 60 according to the first exemplary embodiment is provided inside the device body 2*a* of the image output device 2. As illustrated in FIG. 1, the paper transporting device 60 includes the paper feeding path 61 along which recording paper 5 fed from the paper feeding device 50 is transported to the second-transfer position in the intermediate transfer device 20, the intermediate transport path 62 along which the recording paper 5 having received a set of toner images at the second-transfer position in the intermediate transfer device 20 is transported to the fixing device 40, the outputting transport path 63 along which the recording paper 5 having the set of toner images fixed by the fixing device 40 is transported to the paper receiving member (not illustrated), the reversal transport path 64 along which the recording paper 5 having the set of toner images fixed by the fixing device 40 is reversed before being outputted to the paper receiving member, the duplex transport path 65 along which the recording paper 5 reversed in the reversal transport path 64 is transported through the paper feeding path 61 to the second-transfer position in the intermediate transfer device 20 again, and the external-paper feeding path 66 that is a short path along which recording paper 5, such as long-size paper 5*a*, fed from the external paper feeding device 3 is transported to the paper feeding path 61.

As illustrated in FIG. 2, the paper feeding path 61 includes a vertical transport path 67, which extends vertically to allow the recording paper 5 fed from the paper feeding device 50 to be transported upward in the vertical direction; a curved transport path 68, along which the recording paper 5 transported upward in the vertical direction along the vertical transport path 67 is redirected to be transported in the horizontal direction; and a horizontal transport path 69, along which the recording paper 5 redirected along the curved transport path 68 to be transported in the horizontal direction is transported to the second-transfer position in the intermediate transfer device 20.

The vertical transport path 67 included in the paper feeding path 61 is provided with pairs of paper transporting rolls 671, which transport the recording paper 5; and a guide member 672, which guide the front and back sides of the recording paper 5. The curved transport path 68 included in the paper feeding path 61 is provided with a curved guide member 681, which guides the front and back sides of the recording paper 5.

The horizontal transport path 69 included in the paper feeding path 61 is provided with a plurality (three in the case illustrated in the drawings) of pairs of paper transporting rolls 691 to 693, which transport the recording paper 5 while nipping the recording paper 5; and a guide member 694, which guides the front and back sides of the recording paper 5. Among the three pairs of paper transporting rolls 691 to 693, the pair of paper transporting rolls 693 located at the downstreammost position and immediately before the second-transfer position in the intermediate transfer device 20 serves as a pair of first shift rolls configured to cause the recording paper 5 to undergo a translational movement (to be shifted) in a scanning direction that intersects the direction of transport of the recording paper 5.

Figure 3:
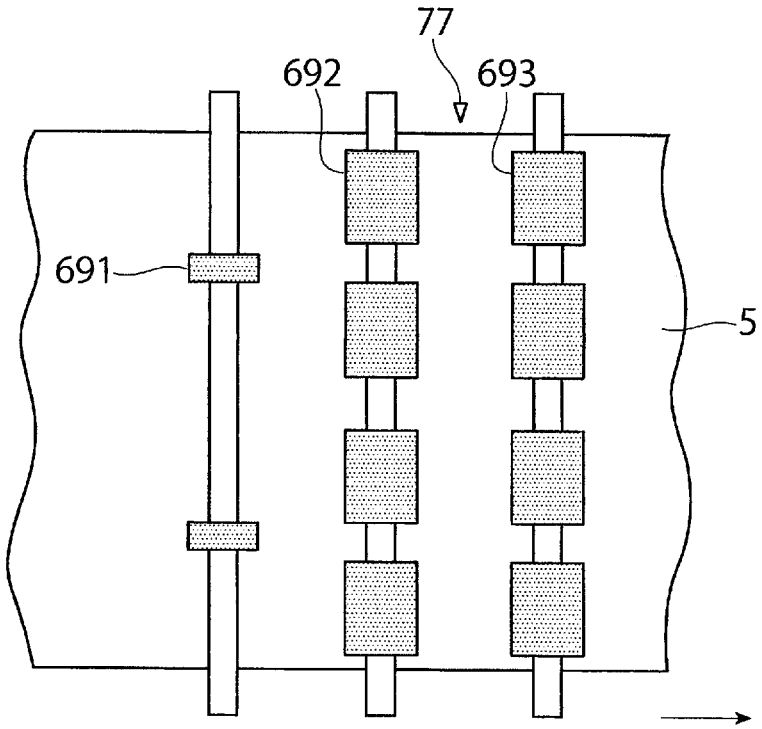
FIG. 3 is a plan view of pairs of paper transporting rolls.
Figure 4:
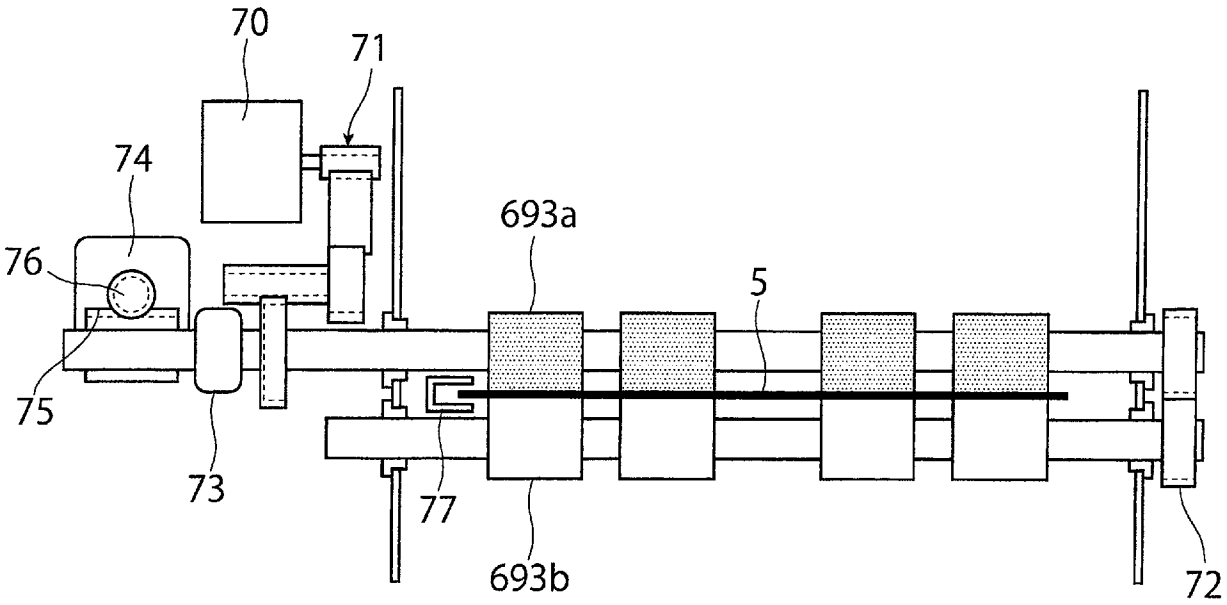
FIG. 4 is a sectional view of one of the pairs of paper transporting rolls and relevant elements.

Referring to FIGS. 3 and 4, the pair of paper transporting rolls 693 serving as the pair of first shift rolls includes a driving roll 693*a*, which is rotated by a driving motor 70 through a reduction gear train 71; and a follower roll 693*b*, which is pressed against the driving roll 693*a* and receives a driving force from the driving roll 693*a* through a transmitting gear 72. The driving roll 693*a* is provided at one end in the axial direction thereof with a bearing 73 and is movable together with the follower roll 693*b* in the axial direction thereof by a moving mechanism that includes a driving motor 74, a rack 75, and a pinion 76, while the movable range of the driving roll 693*a* in the thrust direction is restricted by the bearing 73. A first detector 77 is provided on the upstream side relative to the pair of paper transporting rolls 693 in the direction of transport of the recording paper 5. The first detector 77 is an in-line sensor or the like and is configured to detect the position of the leading end of the recording paper 5 that extends in the direction intersecting the direction of transport of the recording paper 5.

Among the three pairs of paper transporting rolls 691 to 693, the pair of paper transporting rolls 692 located on the upstream side relative to the pair of paper transporting rolls 693 serves as a pair of registration rolls configured to adjust the timing of transport of the recording paper 5 to the second-transfer position. Among the three pairs of paper transporting rolls 691 to 693, the pair of paper transporting rolls 691 located at the upstreammost position cooperates with the other pairs of paper transporting rolls 692 and 693 to transport the recording paper 5.

When the pair of paper transporting rolls 693 serving as the pair of first shift rolls adjusts the position of the recording paper 5 in the scanning direction intersecting the direction of transport of the recording paper 5, the nipping of the recording paper 5 by the pairs of paper transporting rolls other than the pair of transporting rolls 693 is disabled.

Referring to FIG. 1, the intermediate transport path 62 is intended to transport the recording paper 5 having a set of unfixed toner images and is provided with a plurality of or a single transporting belt or the like (not illustrated), with which the recording paper 5 is transported to the fixing device 40. On the downstream side relative to the fixing device 40 in the direction of transport is provided a decurling device 78*a*, which is configured to decurl the recording paper 5.

The outputting transport path 63 is provided with a plurality (three in the case illustrated in FIG. 1) of pairs of paper outputting rolls 631 to 633, with which the recording paper 5 having undergone the fixing process performed by the fixing device 40 is immediately discharged to the outside.

Among the three pairs of paper outputting rolls 631 to 633 provided to the outputting transport path 63, the pair of paper outputting rolls 631 is located at the upstreammost position in the direction of transport of the recording paper 5. On the downstream side relative to the pair of paper outputting rolls 631 are provided a plurality of pairs of paper transporting rolls 641 to 644, with which the recording paper 5 that is redirected by a redirecting component (not illustrated) configured to change the direction of transport of the recording paper 5 is transported along the reversal transport path 64. The reversal transport path 64 extends toward the downstream side in the direction of transport by the plurality of pairs of paper transporting rolls 641 to 644 and further extends below the duplex transport path 65 to form an end portion 645*a*. The direction of rotation of the plurality of pairs of paper transporting rolls 642 to 644 provided to the reversal transport path 64 is switchable between the forward direction and the backward direction. When the recording paper 5 is temporarily transported into the reversal transport path 64 and the plurality of pairs of paper transporting rolls 642 to 644 are then rotated backward, the recording paper 5 is discharged from the reversal transport path 64 and is transported by the pair of output rolls 645 to the paper receiving member (not illustrated), with the front and back sides thereof reversed.

On the other hand, when the recording paper 5 is temporarily transported into the reversal transport path 64 and the pair of paper transporting rolls 644 is then rotated backward, the recording paper 5 is redirected by a redirecting component (not illustrated) toward the duplex transport path 65.

As illustrated in FIGS. 1 and 2, the duplex transport path 65 is provided with a plurality of pairs of paper transporting rolls 651 to 659, which transport the recording paper 5; and a guide member 650, which guides the front and back sides of the recording paper 5. Among the plurality of pairs of paper transporting rolls 651 to 659, the pair of paper transporting rolls 659 located at the downstreammost position and immediately before the paper feeding path 61 serves as a pair of second shift rolls configured to cause the recording paper 5 to undergo a translational movement (to be shifted) in the scanning direction intersecting the direction of transport of the recording paper 5.

Figure 5:
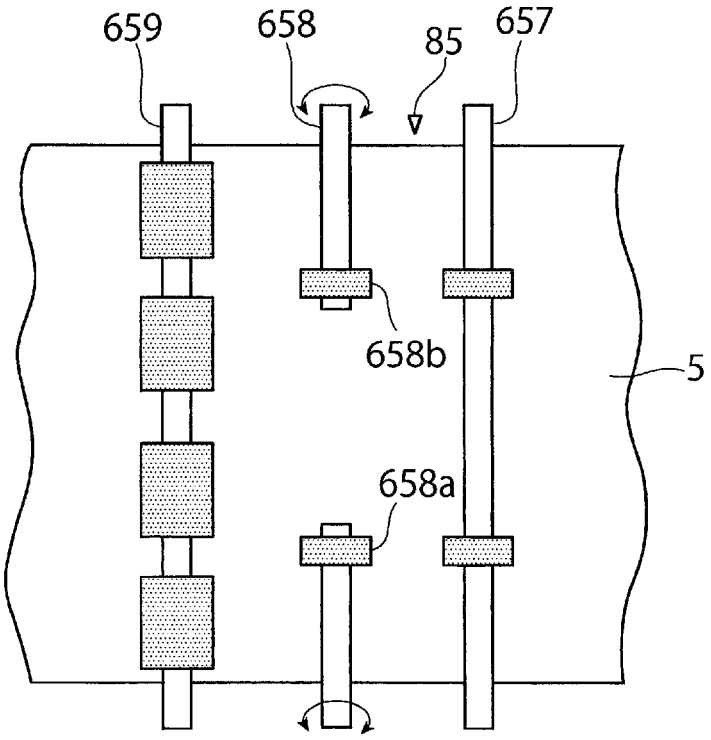
FIG. 5 is a plan view of other pairs of paper transporting rolls.
Figure 6:
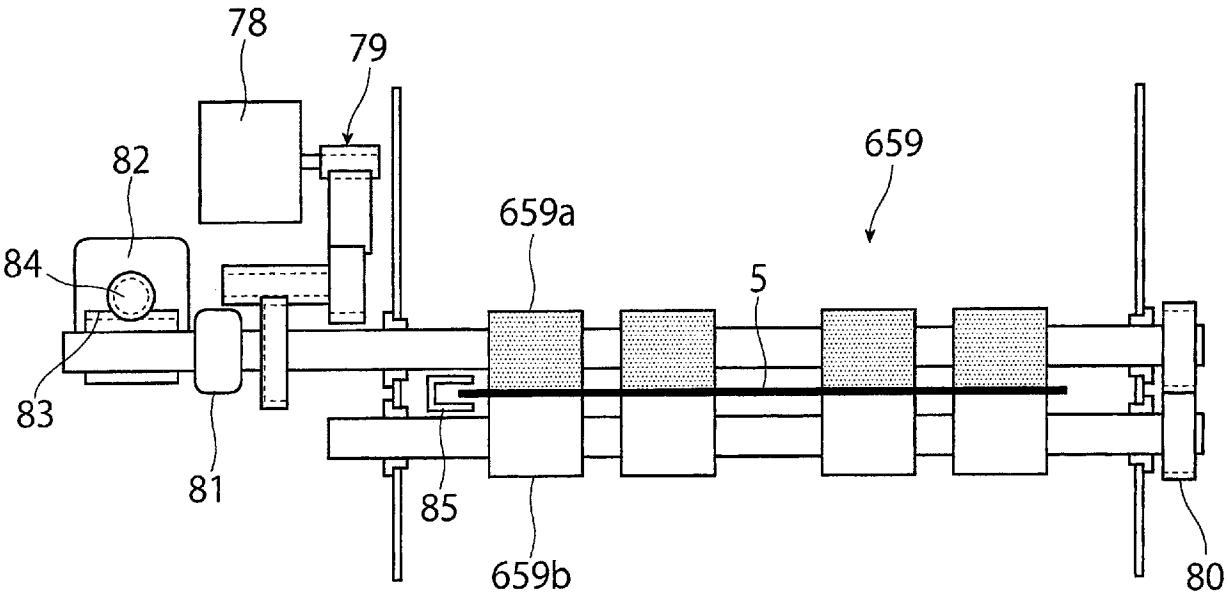
FIG. 6 is a sectional view of one of the pairs of paper transporting rolls and relevant elements.

Referring to FIGS. 5 and 6, the pair of paper transporting rolls 659 serving as the pair of second shift rolls has the same configuration as the pair of paper transporting rolls 693 serving as the pair of first shift rolls. Specifically, the pair of paper transporting rolls 659 serving as the pair of second shift rolls includes a driving roll 659*a*, which is rotated by a driving motor 78 through a reduction gear train 79; and a follower roll 659*b*, which is pressed against the driving roll 659*a* and receives a driving force from the driving roll 659*a* through a transmitting gear 80. The driving roll 659*a* is provided at one end in the axial direction thereof with a bearing 81 and is movable together with the follower roll 659*b* in the axial direction thereof by a moving mechanism that includes a driving motor 82, a rack 83, and a pinion 84, while the movable range of the driving roll 659*a* in the thrust direction is restricted by the bearing 81.

Among the three pairs of paper transporting rolls 657 to 659, the pair of paper transporting rolls 658 located on the upstream side relative to the pair of paper transporting rolls 659 serves as a pair of skew correcting rolls, which is an exemplary skew correcting component and is configured to correct any skew of the recording paper 5.

Figure 7:
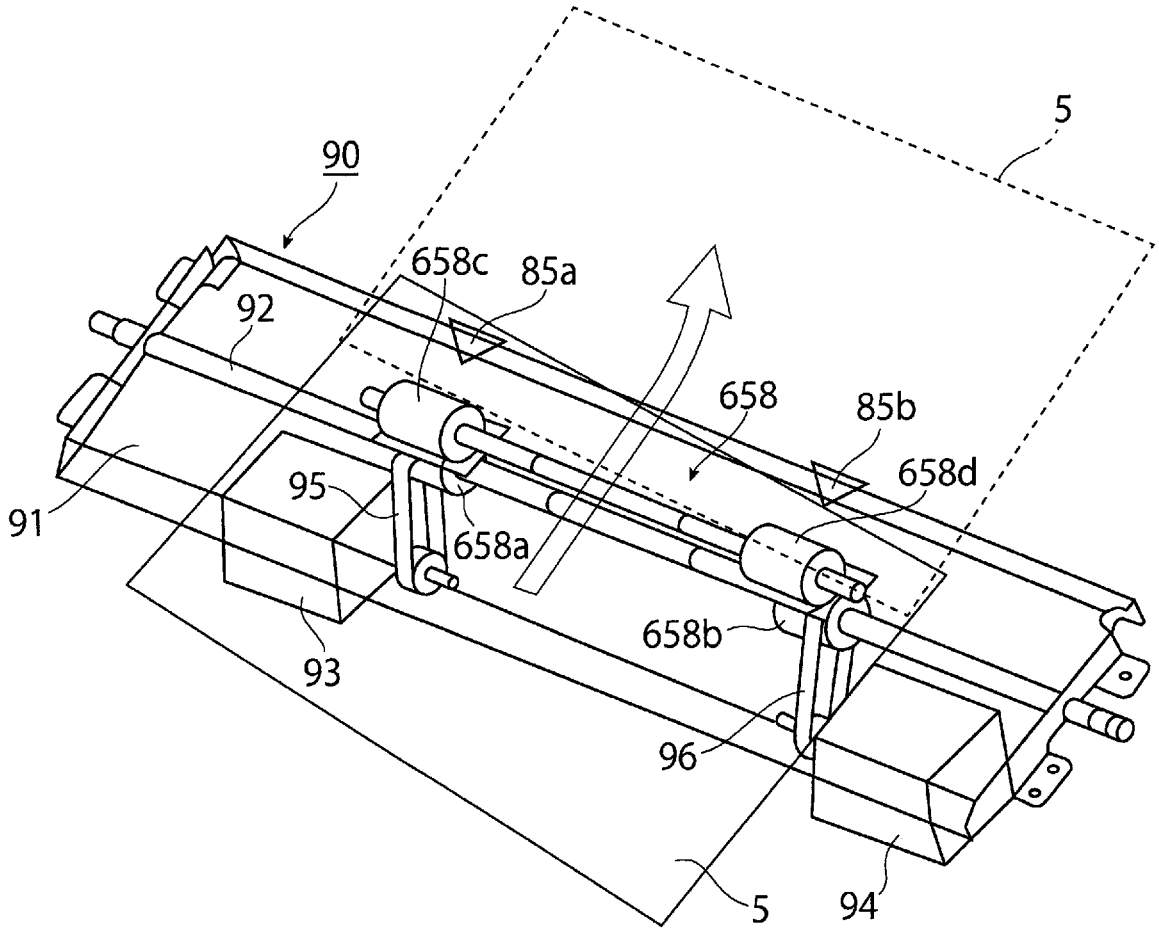
FIG. 7 is a perspective view of one of the pairs of paper transporting rolls that serves as a skew correcting component.
Figure 8:
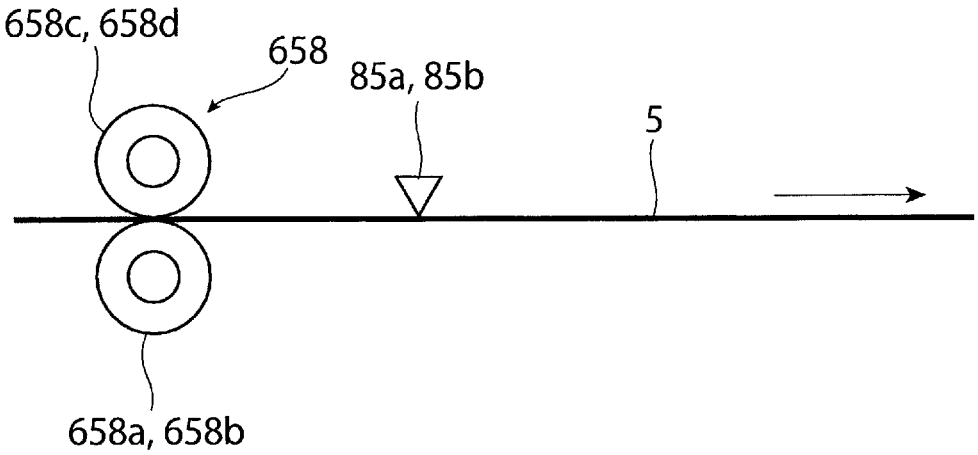
FIG. 8 is a sectional view of the pair of paper transporting rolls serving as a skew correcting component.

Referring to FIGS. 7 and 8, the pair of paper transporting rolls 658 includes a first driving roll 658*a*, which is an exemplary first transporting component and is located on the front side in the axial direction (width direction) intersecting the direction of transport of the recording paper 5; and a second driving roll 658*b*, which is an exemplary second transporting component and is located on the rear side in the axial direction. The amounts of rotation (rotation speeds) of the first driving roll 658*a* and the second driving roll 658*b* are controllable independently of each other. The pair of paper transporting rolls 658 further includes on the upper side thereof follower rolls 658*c* and 658*d*, which are arranged at respective positions in the axial direction and are rotatable independently of each other.

The first and second driving rolls 658*a* and 658*b* are rotatable independently of each other on a rotation shaft 92, which is fixed to or rotatably attached to the housing, 91, of a skew correcting device 90. The first and second driving rolls 658*a* and 658*b* are to be rotated independently of each other by first and second driving motors 93 and 94 with the aid of respective driving belts 95 and 96 at respective predetermined rotation speeds. The first and second follower rolls 658*c* and 658*d* are in contact with the first and second driving rolls 658*a* and 658*b* from above, thereby being rotatable independently of each other. The pair of paper transporting rolls 658 is configured to correct any skew of the recording paper 5 while nipping the recording paper 5, with the amounts of rotation (rotation speeds) of the first driving roll 658*a* and the second driving roll 658*b* changed individually.

On the downstream side relative to the pair of paper transporting rolls 658 in the direction of transport of the recording paper 5 are provided a pair of second detectors 85*a* and 85*b*, which are each configured to detect the position of the leading end of the recording paper 5 that extends in the direction intersecting the direction of transport of the recording paper 5. The second detectors 85*a* and 85*b* are arranged at respective positions that are in bilateral symmetry with respect to the center of the recording paper 5 in the direction intersecting the direction of transport. The second detectors 85*a* and 85*b* each output a detection signal to the control device 100.

Among the three pairs of paper transporting rolls 657 to 659, the pair of paper transporting rolls 657 located at the upstreammost position cooperates with the pairs of paper transporting rolls 651 to 656 and other relevant elements to transport the recording paper 5.

Referring to FIG. 2, the external-paper feeding path 66 is provided with a pair of paper transporting rolls 661, which transports the recording paper 5 received from the external paper feeding device 3 while nipping the recording paper 5; and a guide member 662, which guides the front and back sides of the recording paper 5.

The image forming apparatus 1 to which the paper transporting device 60 configured as above is applied is capable of forming an image on the long-size paper 5*a* that is fed from the external paper feeding device 3 or the like. The long-size paper 5*a* does not necessarily need to be fed from the external paper feeding device 3 and may be fed from the inside of the image forming apparatus 1. The long-size paper 5*a*, which is exemplary recording paper 5, is longer than standard-size paper in the direction of transport and is therefore more likely to skew relative to the direction of transport while being transported in the paper transporting device 60. The long-size paper 5*a* is more likely to skew than the standard-size recording paper 5 particularly in duplex image formation, in which any recording paper 5 is to be transported along a very long path. Specifically, the long-size paper 5*a* having an image on one side thereof is to be transported from the outputting transport path 63 and along the reversal transport path 64 for the reversal of the front and back sides thereof, and to be further transported along the duplex transport path 65 and the paper feeding path 61 to the second-transfer position in the intermediate transfer device 20.

In view of the above, as illustrated in FIG. 2 and described above, the paper transporting device 60 according to the first exemplary embodiment includes the pair of paper transporting rolls 659 serving as the pair of second shift rolls, the pair of paper transporting rolls 658 serving as an exemplary skew correcting component, and the pair of paper transporting rolls 657 in an area of the duplex transport path 65 that is at the downstreammost position in the direction of transport of the recording paper 5. The pair of paper transporting rolls 659 serving as the pair of second shift rolls is configured to correct the position of the recording paper 5 in the direction intersecting the direction of transport by causing the recording paper 5 to undergo a translational movement after any skew of the recording paper 5 is corrected by the pair of paper transporting rolls 658.

In the paper transporting device 60, referring to FIG. 8, while the pair of paper transporting rolls 658 is transporting the long-size paper 5*a* by a predetermined length, the second detectors 85*a* and 85*b* detect the position of the leading end of the long-size paper 5*a*, whereby the amount of skew of the long-size paper 5*a* is calculated.

If the control device 100 receives a detection signal representing that the long-size paper 5*a* is skewed, the nipping of the long-size paper 5*a* by the pairs of paper transporting rolls 659 and 657 and others is disabled first. Then, the skew of the long-size paper 5*a* is corrected by the pair of paper transporting rolls 658 serving as the pair of skew correcting rolls. Furthermore, the position of the long-size paper 5*a* in the direction intersecting the direction of transport is corrected by the pair of paper transporting rolls 659 serving as the pair of second shift rolls, before the long-size paper 5*a* is transported by the pair of paper transporting rolls 659 and others.

The pair of paper transporting rolls 658 serving as the pair of skew correcting rolls is configured to correct any skew of the recording paper 5 with reference to the amount of skew of the recording paper 5 that is detected by the second detectors 85*a* and 85*b*. The correction of the skew of the recording paper 5 is performed by driving the first and second driving rolls 658*a* and 658*b* of the pair of paper transporting rolls 658 with a speed gap therebetween. There are two possible cases of driving of the first and second driving rolls 658*a* and 658*b* of the pair of paper transporting rolls 658 with a speed gap: a case where the driving rolls 658*a* and 658*b* of the pair of paper transporting rolls 658 are decelerated with a time gap therebetween, and a case where the driving rolls 658*a* and 658*b* of the pair of paper transporting rolls 658 are accelerated with a time gap therebetween. In the first exemplary embodiment, the driving rolls 658*a* and 658*b* of the pair of paper transporting rolls 658 configured to correct the skew of the recording paper 5 are to be decelerated with a time gap therebetween. The driving scheme is not limited to the above; that is, the driving rolls 658*a* and 658*b* of the pair of paper transporting rolls 658 may be accelerated with a time gap therebetween.

Figure 9:
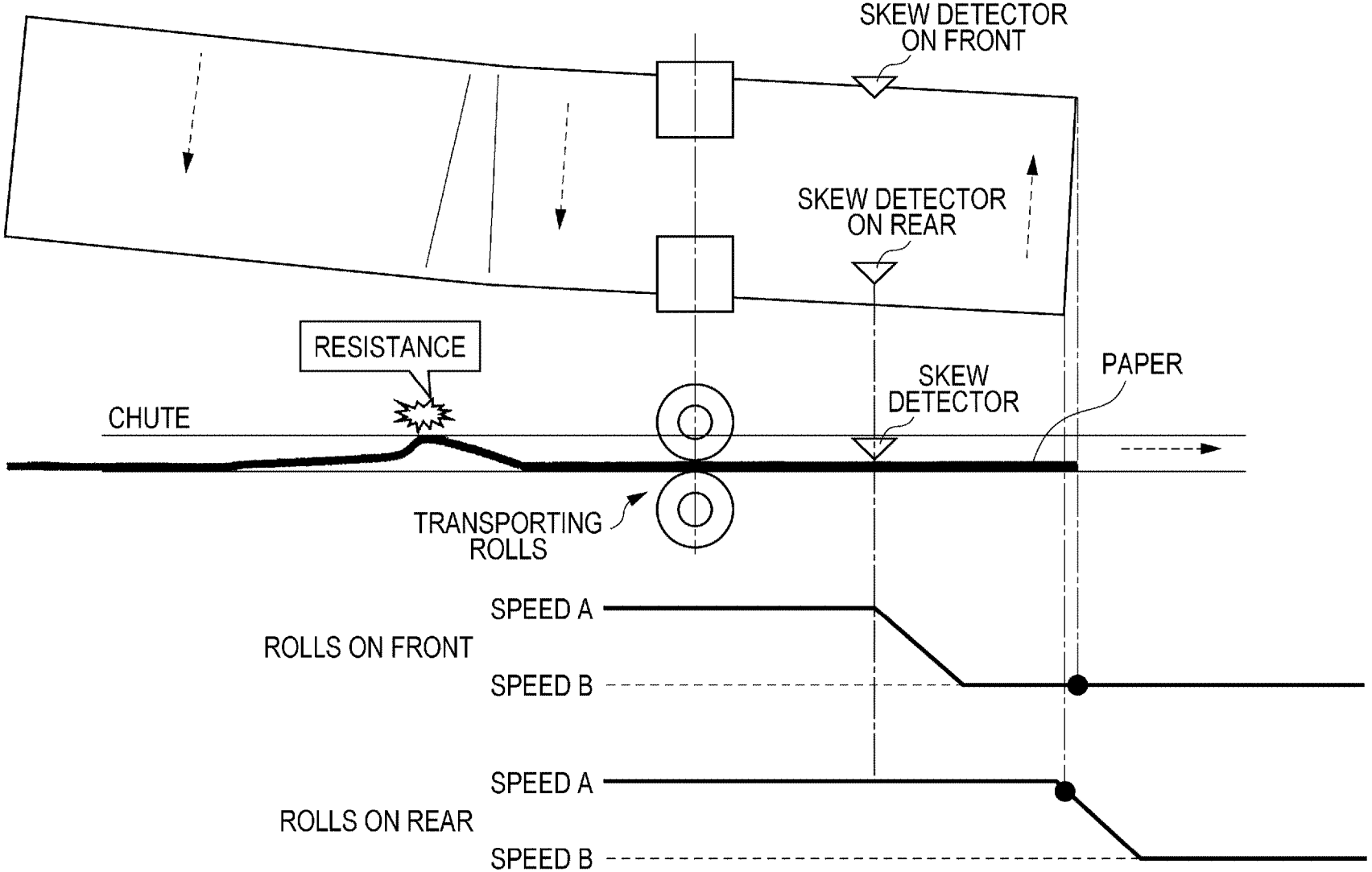
FIG. 9 RELATED ART
FIG. 9 illustrates how a skew of recording paper is corrected by a related-art sheet transporting device.
Figure 10:
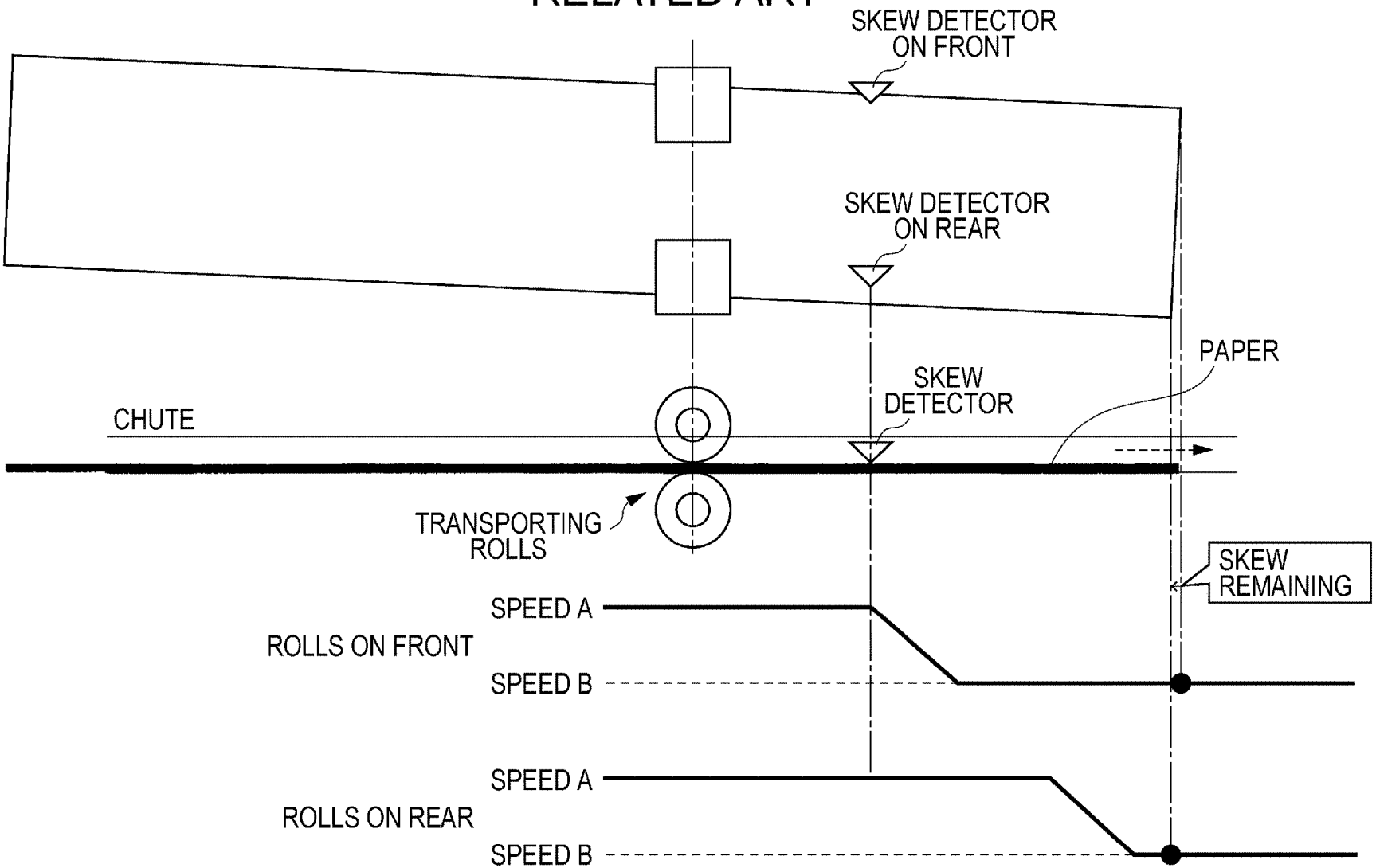
FIG. 10 RELATED ART
FIG. 10 illustrates how a skew of recording paper is corrected by the related-art sheet transporting device.

However, a technical problem may occur with some kinds of recording paper 5 including the following: long-size paper 5*a* having a greater length in the direction of transport than plain paper, cardboard having a greater basis weight (over 200 gsm, for example) than plain paper, and embossed paper or the like having greater surface irregularities than plain paper and therefore exhibits poorer characteristics relevant to sheet transport than plain paper. Specifically, when the skew of the recording paper 5 is corrected by the pair of paper transporting rolls 658, recording paper 5 of any of the above kinds generates a greater contact resistance than plain paper with respect to a member such as the guide member 650 along which the recording paper 5 is transported. In particular, in the case where the member such as the guide member 650 along which the recording paper 5 is transported is not flat but is curved upward or downward, the contact resistance of the above listed recording paper 5 to such member is much greater than that of plain paper. Therefore, if the driving rolls 658*a* and 658*b* of the pair of paper transporting rolls 658 are driven in accordance with a normal deceleration profile and with a speed gap that is set for plain paper, the skew correction for the recording sheet 5 may be incomplete as illustrated in FIGS. 9 and 10; that is, the accuracy in the skew correction may be lowered.

In view of the above, the paper transporting device 60 according to the first exemplary embodiment includes a changing component configured to change, with reference to a characteristic relevant to sheet transport, the state of the speed-gap driving of the skew correcting component. Herein, the state of the speed-gap driving relates to, for example, the time period to be spent for deceleration of each of the first and second transporting components from a first transporting speed A to a second transporting speed B.

Figure 11:
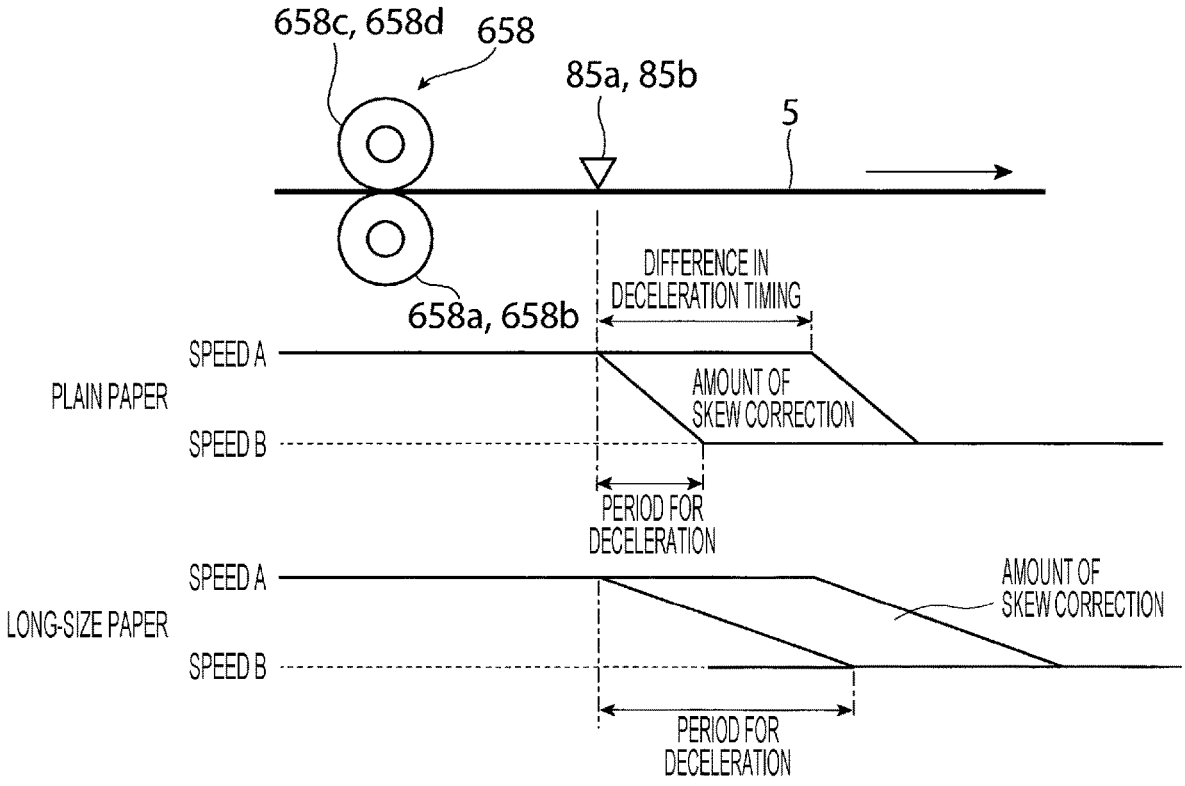
FIG. 11 illustrates how the paper transporting device operates as an exemplary sheet transporting device according to the first exemplary embodiment of the present disclosure.

In the paper transporting device 60 according to the first exemplary embodiment, referring to FIG. 11, while the recording paper 5 is being transported by the pair of paper transporting rolls 658 at a predetermined normal speed, the second detectors 85*a* and 85*b* detect the leading end of the recording paper 5.

If the recording paper 5 such as long-size paper 5*a* has any skew, either of the two second detectors 85*a* and 85*b* first detects the leading end of the recording paper 5, and the other of the second detectors 85*a* and 85*b* detects the leading end of the recording paper 5 with a delay.

With reference to the gap, $\Delta T$, between the time points of detection of the leading end of the recording paper 5 by the two second detectors 85*a* and 85*b* and the speed of transport, V, of the recording paper 5, the amount of skew, S, of the recording paper 5 is calculated by the control device 100.

Referring to FIG. 11, in a normal case where the recording paper 5 is plain paper or the like, if one of the two second detectors 85*a* and 85*b* first detects the leading end of the recording paper 5 and the other of the second detectors 85*a* and 85*b* subsequently detects the leading end of the recording paper 5, the control device 100 first starts reducing the transporting speed of one of the first and second driving rolls 658*a* and 658*b* of the pair of paper transporting rolls 658 that is located on the ahead side of the recording paper 5 and continues to reduce the transporting speed for the ahead side until the transporting speed reaches the second transporting speed B, which is set in advance with reference to a predetermined time period of deceleration. In such a normal case, the time period to be spent for deceleration from the first transporting speed A to the second transporting speed B is constant regardless of the amount of skew S of the recording paper 5.

When a time period corresponding to a predetermined gap in the timing of starting deceleration elapses after the control device 100 starts reducing the transporting speed of one of the driving rolls 658*a* and 658*b* of the pair of paper transporting rolls 658 that is located on the ahead side of the recording paper 5, the control device 100 starts reducing the transporting speed of the other of the driving rolls 658*a* and 658*b* of the pair of paper transporting rolls 658 that is located on the behind side of the recording paper 5. The amount of correction of the skew of the recording paper 5 by the pair of paper transporting rolls 658 is determined as the product of the gap between the first transporting speed A and the second transporting speed B and the gap in the timing of deceleration; that is, the area of a parallelogram illustrated in FIG. 11.

In the paper transporting device 60 according to the first exemplary embodiment, the time period to be spent for deceleration from the first transporting speed A to the second transporting speed B varies with the characteristic relevant to the transport of the recording paper 5 and is changed by the control device 100, serving as an exemplary changing component, with reference to a characteristic relevant to the transport of the recording paper 5. The characteristic relevant to the transport of the recording paper 5 refers to any of the characteristics of the recording paper 5 that affect the transport of the recording paper 5 and includes at least one of the following, for example: the length of the recording paper 5 in the direction of transport and/or the direction intersecting the direction of transport, the basis weight of the recording paper 5, and the material of the recording paper 5.

Figure 12:
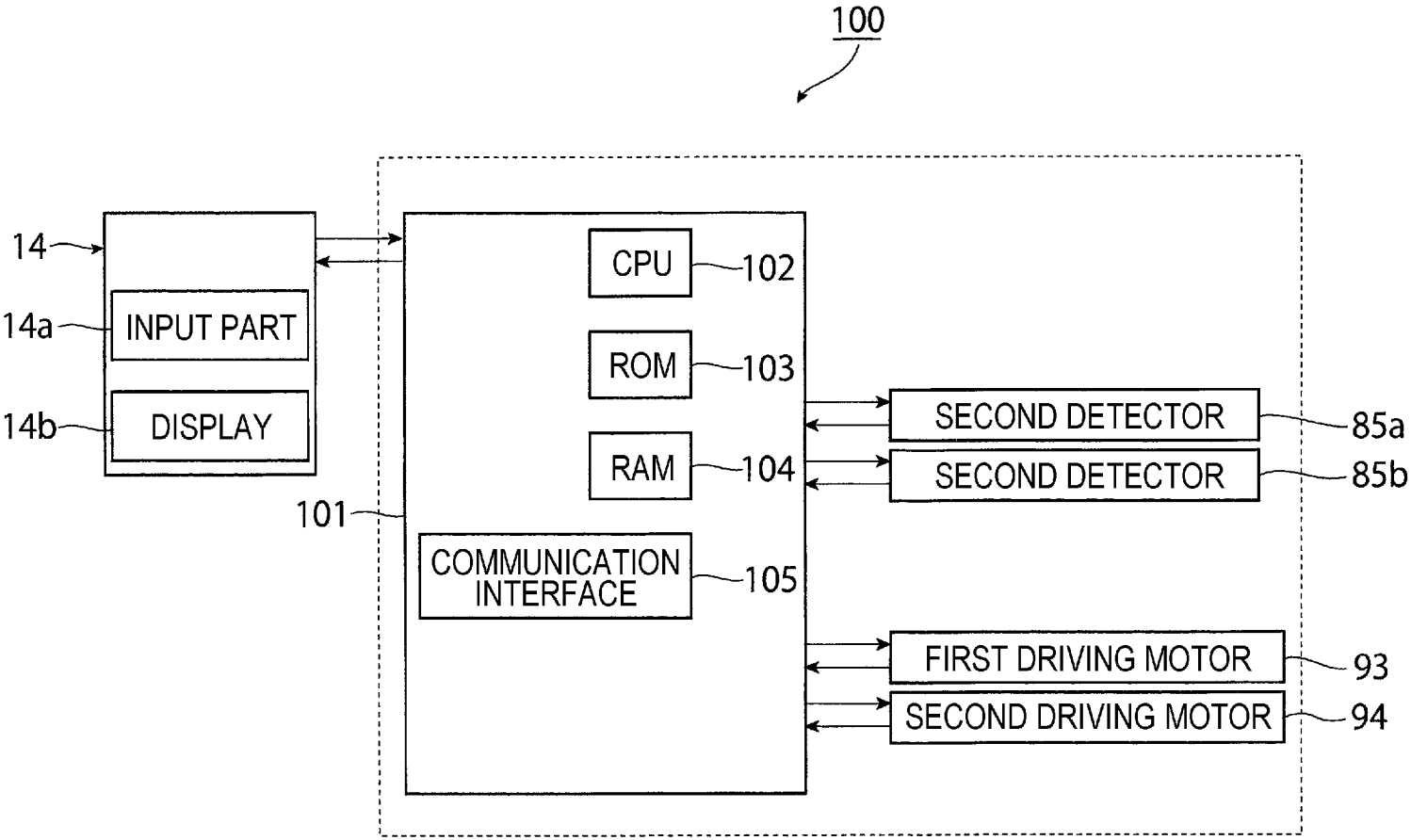
FIG. 12 is a block diagram of a control device included in the image forming apparatus to which the sheet transporting device according to the first exemplary embodiment of the present disclosure is applied.

FIG. 12 is a block diagram of the control device 100 included in the image forming apparatus 1.

The control device 100 illustrated in FIG. 12 includes a controller 101, which is an exemplary controlling component and is configured to generally control the operation of the image forming apparatus 1. The controller 101 includes a central processing unit (CPU) 102, which is configured to generally control the image forming operation and also serves as the changing component; a read-only memory (ROM) 103, which is configured to store control programs and the like to be executed by the CPU 102; a random access memory (RAM) 104, which is configured to store parameters and the like to be used in the control programs and the like to be executed by the CPU 102; buses (not illustrated) that connect the foregoing elements including the CPU 102 and the ROM 103 to one another; and a communication interface 105, through which the controller 101 communicates with devices such as an external personal computer and an image reading device.

The controller 101 receives from an input part 14*a* and a display 14*b*, which are included in an operation device 14, information such as the size and kind (including basis weight) of the recording paper 5 on which an image is to be formed, the number of copies to be printed, and conditions for image formation representing simplex printing, duplex printing, or the like. The controller 101 controls the first and second driving motors 93 and 94, which are stepping motors or the like, configured to drive the driving rolls 658*a* and 658*b* of the pair of paper transporting rolls 658 with reference to relevant information including the detection signals transmitted from the second detectors 85*a* and 85*b*.

Information stored in the ROM 103 in advance includes the characteristics relevant to the transport of the recording paper 5, including the length of the recording paper 5 in the direction of transport and/or in the direction intersecting the direction of transport and the basis weight of the recording paper 5; and mathematical expressions and correction factors to be used for the calculation of values relevant to the time period to be spent for changing the transporting speed of each of the driving rolls 658*a* and 658*b* of the pair of paper transporting rolls 658 from the first transporting speed A to the second transporting speed B.

If the length of the recording paper 5 in the direction of transport is smaller than or equal to the length of the longer side of the recording paper 5 of size A3, the time period to be spent for deceleration of each of the driving rolls 658*a* and 658*b* of the pair of paper transporting rolls 658 from the first transporting speed A to the second transporting speed B is set to a prestored normal value. If the length of the recording paper 5 in the direction of transport is greater than the length of the longer side of the recording paper 5 of size A3, the time period to be spent for deceleration of each of the driving rolls 658*a* and 658*b* of the pair of paper transporting rolls 658 from the first transporting speed A to the second transporting speed B is set to the product of the normal value and a predetermined factor C (an integer greater than 1 or a decimal).

If the basis weight of the recording paper 5 is greater than the basis weight of plain paper, specifically greater than 200 gsm, the time period to be spent for deceleration of each of the driving rolls 658*a* and 658*b* of the pair of paper transporting rolls 658 from the first transporting speed A to the second transporting speed B is set to the product of the normal value and a predetermined factor C1 (an integer greater than 1 or a decimal).

If the recording paper 5 is any special paper such as embossed paper, the time period to be spent for deceleration of each of the driving rolls 658*a* and 658*b* of the pair of paper transporting rolls 658 from the first transporting speed A to the second transporting speed B is set to the product of the normal value and a predetermined factor C2 (an integer greater than 1 or a decimal).

Functions of Paper Transporting Device

Figure 13A:
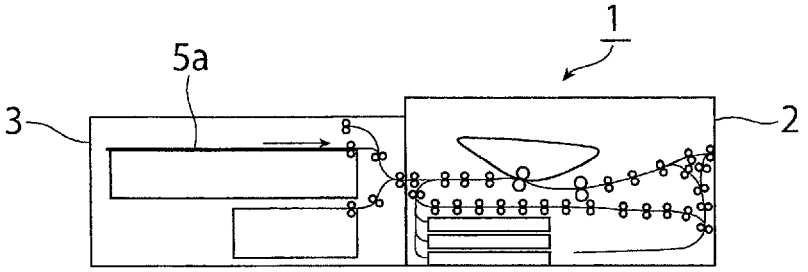
FIGS. 13A to 13H illustrate how long-size paper is transported in the image forming apparatus to which the sheet transporting device according to the first exemplary embodiment of the present disclosure is applied.
Figure 13B:
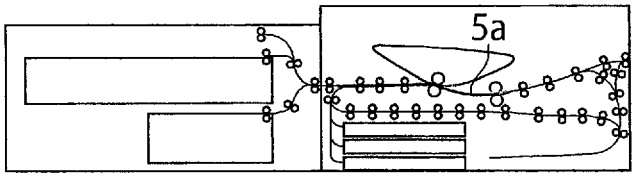
Figure 13C:
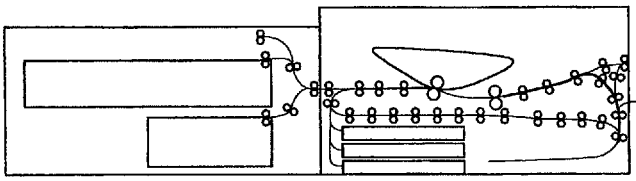
Figure 13D:
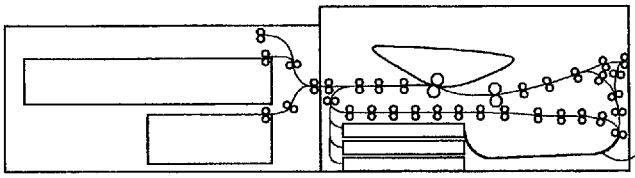
Figure 13E:
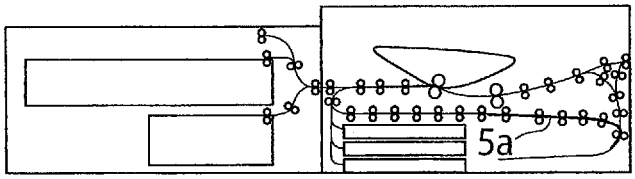
Figure 13F:
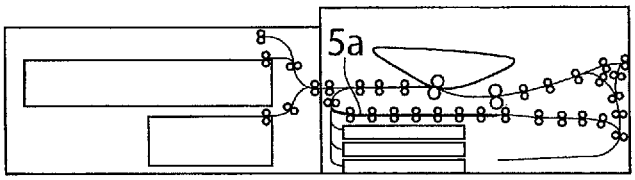
Figure 13G:
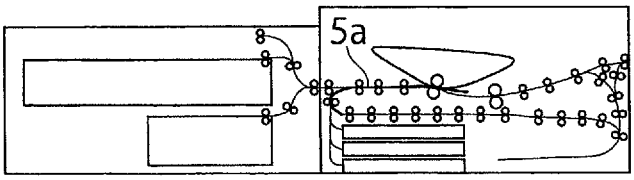
Figure 13H:
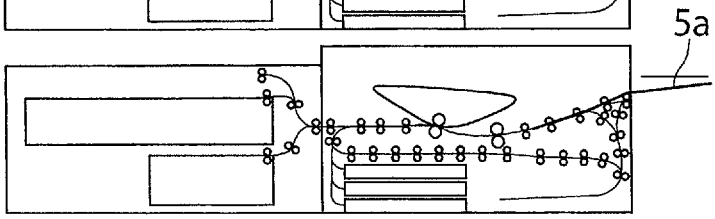

According to the first exemplary embodiment, in the process of forming an image on each of the two sides of any long-size paper 5*a*, the long-size paper 5*a* is fed from the paper feeding device 3 to the paper transporting device 60 as illustrated in FIG. 13A.

Accordingly, the control device 100 acknowledges that the recording paper 5 designated by the user is not plain paper but long-size paper 5*a*.

The long-size paper 5*a* fed from the paper feeding device 3 enters the image output device 2 and is transported along the external-paper feeding path 66 and the paper feeding path 61 in the paper transporting device 60 to the second-transfer position in the intermediate transfer device 20. In this process, referring to FIG. 2, the position of the long-size paper 5*a* in the direction intersecting the direction of transport is detected by the first detector 77 located on the upstream side relative to the pair of paper transporting rolls 693. If any misregistration of the long-size paper 5*a* in the direction intersecting the direction of transport is detected, the position of the long-size paper 5*a* is adjusted by the pair of paper transporting rolls 693, illustrated in FIG. 4.

Subsequently, after an image is formed and fixed on one side of the long-size paper 5*a*, as illustrated in FIGS. 13C to 13F, the long-size paper 5*a* is reversed by being transported along the outputting transport path 63 and the reversal transport path 64 and is transported to the duplex transport path 65.

Figure 14:
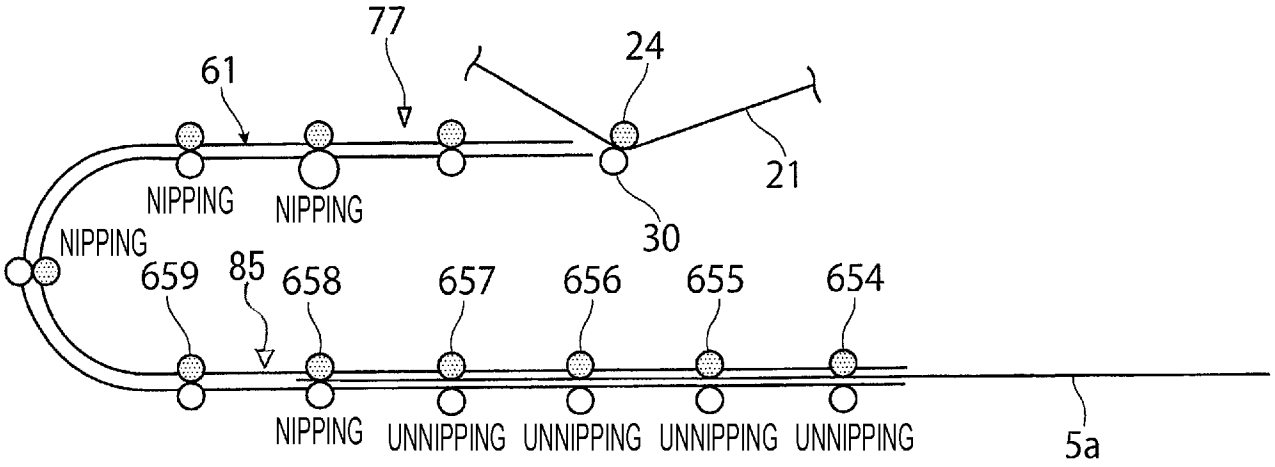
FIG. 14 illustrates how long-size paper is transported by the paper transporting device according to the first exemplary embodiment of the present disclosure.

Referring to FIG. 14, the long-size paper 5*a* thus transported to the duplex transport path 65 is further transported to the pair of paper transporting rolls 657 and the pair of paper transporting rolls 658.

In this state, the pair of paper transporting rolls 658 is in the nipping position.

Subsequently, the control device 100 activates the pair of paper transporting rolls 658, and the second detectors 85*a* and 85*b* detect the amount of skew of the long-size paper 5*a*.

If any skew of the long-size paper 5*a* is detected by the second detectors 85*a* and 85*b*, the control device 100 corrects the skew of the long-size paper 5*a* by controlling the pair of paper transporting rolls 658 with reference to the amount of detected skew of the long-size paper 5*a*.

This state of the paper transporting device 60 is illustrated in FIG. 14, where the pair of paper transporting rolls 658 is nipping the long-size paper 5*a* while the pairs of paper transporting rolls 651 to 657 located on the upstream side relative to the pair of paper transporting rolls 658 are all in the unnipping position.

To correct the skew of the long-size paper 5*a* by controlling the pair of paper transporting rolls 658 with reference to the amount of detected skew of the long-size paper 5*a*, referring to FIG. 11, the control device 100 calculates the time period to be spent for deceleration of each of the first and second driving motors 93 and 94 with reference to the length of the long-size paper 5*a* in the direction of transport.

Figure 15:
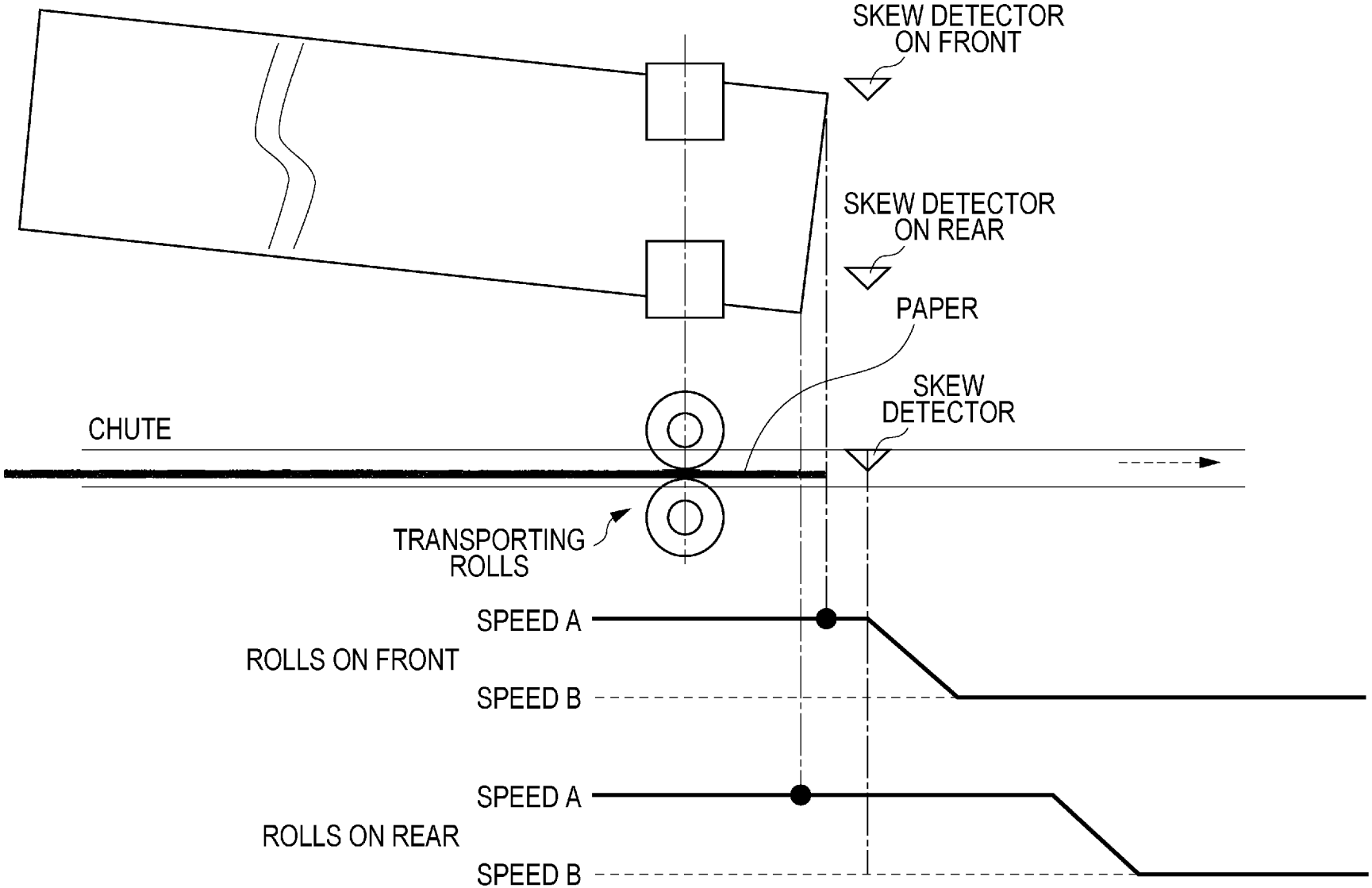
FIG. 15 illustrates a state of skew correction for long-size paper in the image forming apparatus to which the sheet transporting device according to the first exemplary embodiment of the present disclosure is applied.
Figure 16:
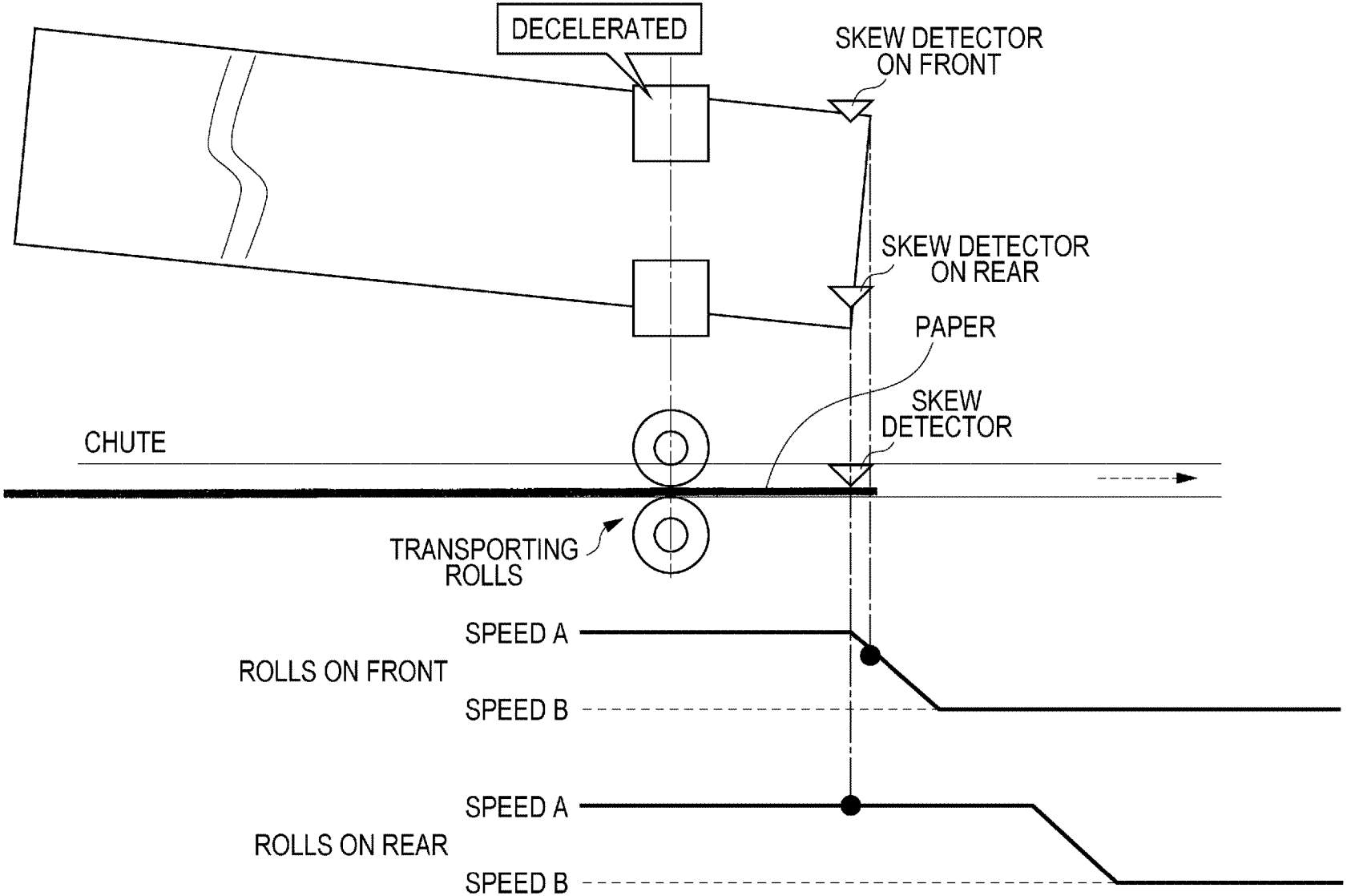
FIG. 16 illustrates another state of skew correction for long-size paper in the image forming apparatus to which the sheet transporting device according to the first exemplary embodiment of the present disclosure is applied.

In this calculation, referring to FIGS. 15 and 16, the control device 100 calculates the amount of skew as the gap between the times of arrival of the leading end of the long-size paper 5*a* at the respective points of detection by the second detectors 85*a* and 85*b*.

Subsequently, when the behind side of the leading end of the long-size paper 5*a* is detected by a corresponding one of the second detectors 85*a* and 85*b*, the control device 100 starts a decelerating operation in which the driving speed of one of the first and second driving motors 93 and 94 that is for the ahead side is reduced from the driving speed for the first transporting speed A to the driving speed for the second transporting speed B.

Furthermore, with reference to the amount of skew of the long-size paper 5*a*, the control device 100 calculates the timing of starting another decelerating operation in which the driving speed of the other of the first and second driving motors 93 and 94 that is for the behind side is reduced from the driving speed for the first transporting speed A to the driving speed for the second transporting speed B, and the control device 100 reduces the driving speed of the first or second driving motor 93 or 94 that is for the behind side from the driving speed for the first transporting speed A to the driving speed for the second transporting speed B by spending a calculated time period of deceleration. When the driving speed of the first or second driving motor 93 or 94 that is for the behind side reaches the driving speed for the second transporting speed B, the operation of correcting the skew of the long-size paper 5*a* is complete.

To summarize, in the paper transporting device 60 according to the first exemplary embodiment, the time period to be spent for reducing the driving speed of each of the first and second driving motors 93 and 94 from the driving speed for the first transporting speed A to the driving speed for the second transporting speed B is changed with reference to a characteristic relevant to the transport of the recording paper 5. Specifically, if the recording paper 5 is long-size paper 5*a* or the like that has a long length in the direction of transport, the time period to be spent for reducing the driving speed of each of the first and second driving motors 93 and 94 from the driving speed for the first transporting speed A to the driving speed for the second transporting speed B is increased. Therefore, if the recording paper 5 is long-size paper 5*a* or the like that has a long length in the direction of transport, since the time period to be spent for reducing the driving speed of each of the first and second driving motors 93 and 94 from the driving speed for the first transporting speed A to the driving speed for the second transporting speed B is increased, the decelerating operation is performed slowly with a gentler speed gradient.

Second Exemplary Embodiment

Figure 17A:
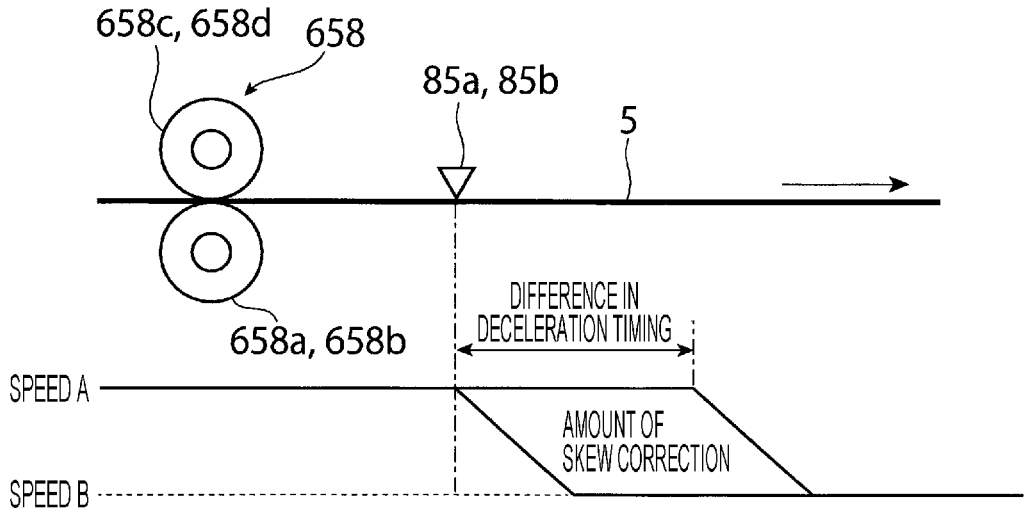
FIGS. 17A and 17B illustrate different states of skew correction in an image forming apparatus to which a sheet transporting device according to a second exemplary embodiment of the present disclosure is applied.
Figure 17B:
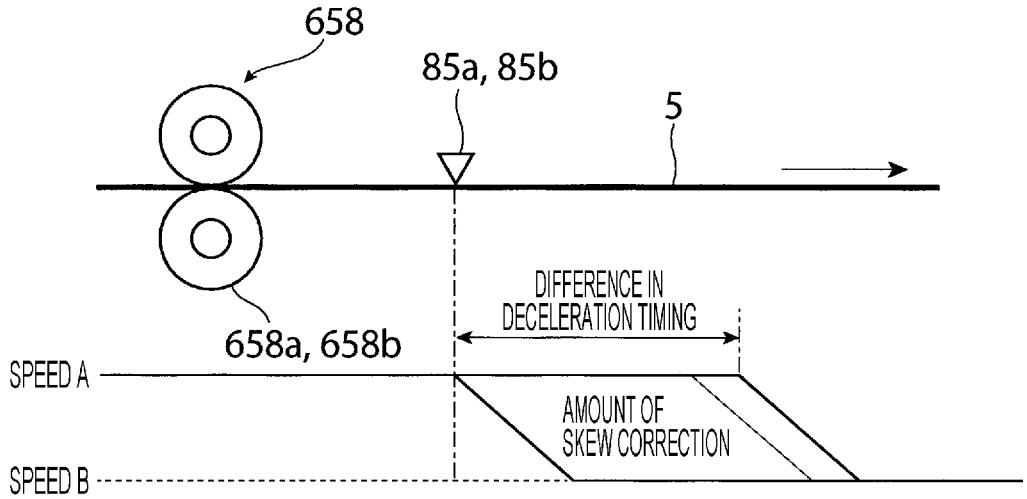

FIGS. 17A and 17B illustrate different states of skew correction in an image forming apparatus to which a sheet transporting device according to a second exemplary embodiment of the present disclosure is applied.

A paper transporting device 60 according to the second exemplary embodiment includes a skew correcting component configured such that the timing of changing the transporting speed of each of the first and second transporting components from the first transporting speed A to the second transporting speed B is changed with reference to the amount of sheet skew.

Furthermore, in the paper transporting device 60 according to the second exemplary embodiment, the state of the speed-gap driving is controlled such that the timing of changing the transporting speed of each of the first and second transporting components from the first transporting speed A to the second transporting speed B is changed with reference to a characteristic relevant to sheet transport.

Specifically, in the paper transporting device 60 according to the second exemplary embodiment, referring to FIGS. 17A and 17B, if a skew of any amount is detected as the gap between the times of arrival of the leading end of the long-size paper 5*a* at the respective points of detection by the second detectors 85*a* and 85*b*, the control device 100 starts, at the detection of the leading end of the recording paper 5 by one of the second detectors 85*a* and 85*b* that is for the behind side, a decelerating operation in which the driving speed of one of the first and second driving motors 93 and 94 that is for the ahead side is reduced from the driving speed for the first transporting speed A to the driving speed for the second transporting speed B.

To calculate the timing of starting the deceleration of the first or second driving motor 93 or 94 that is for the behind side from the driving speed for the first transporting speed A to the driving speed for the second transporting speed B with reference to the amount of skew of the recording paper 5, the control device 100 multiplies the normal value for the timing of starting the decelerating operation by an adjustment factor corresponding to the characteristic relevant to the transport of the recording paper 5 of interest.

The gap in the timing of deceleration is denoted by ΔT and is calculated as follows, for example:

$$\Delta T = \text{speed } A \times t(\text{speed } A - \text{speed } B) \times \alpha$$

$$\alpha = \beta \times \gamma \times \eta \times \varepsilon$$

(where $3 \geq \alpha \geq 1$)

In the above expression, α denotes the correction factor, β denotes the basis-weight factor, γ denotes the paper-size factor, η denotes the paper-type factor, ε denotes the environmental-adjustment factor, and t denotes the gap in the timing of detection between the second detectors 85*a* and 85*b*. The basis-weight factor β, the paper-size factor γ, the paper-type factor η, and the environmental-adjustment factor ε are predetermined as summarized in FIGS. 18 to 21, for example, and are stored in the ROM 103. The length of the recording paper 5 is expressed in mm, the ambient temperature is expressed in ° C., and the ambient humidity refers to relative humidity and is expressed in RH %.

Referring to FIG. 18, the basis-weight factor β is 0.5 for below 63 gsm, 0.8 for 63 gsm and above but below 105 gsm, 1.0 for 105 gsm and above but below 220 gsm, 1.5 for 220 gsm and above but below 300 gsm, 2.0 for 300 gsm and above but below 350 gsm, and 3.0 for 350 gsm and above.

Referring to FIG. 19, the paper-size factor γ is 0.5 for below 210 mm, 0.8 for 210 mm and above but below 420 mm, 1.0 for 420 mm and above but below 488 mm, 1.1 for 488 mm and above but below 600 mm, 1.2 for 600 mm and above but below 800 mm, 1.3 for 800 mm and above but below 1000 mm, 1.4 for 1000 mm and above but below 1200 mm, and 1.5 for 1200 mm and above.

Referring to FIG. 20, the paper-type factor η is 1 for plain paper; and 1.2 for coated paper, embossed paper, and film.

Referring to FIG. 21, the environmental-adjustment factor ε is expressed as the correction value for ambient temperature times the correction value for ambient humidity. The correction values are as follows: 1.1 for below 10° C., 1.0 for 10° C. and above but below 20° C., 1.1 for 20° C. and above but below 30° C., and 1.2 for 30° C. and above; and 1.1 for below 5 RH %, 1.0 for 5 RH % and above but below 50 RH %, and 1.1 for 50 RH % and above up to 100 RH % inclusive.

To summarize, the paper transporting device 60 according to the second exemplary embodiment is configured such that the gap in the timing of deceleration from the driving speed for the first transporting speed A to the driving speed for the second transporting speed B between one of the first and second driving motors 93 and 94 that is for the ahead side and the other that is for the behind side is changed with reference to a characteristic relevant to the transport of the recording paper 5. Specifically, if the recording paper 5 is long-size paper 5*a* or the like that has a long length in the direction of transport, the paper-size factor is set to such a value greater than 1 as to delay the timing of deceleration of the driving motor 93 or 94 that is for the behind side from the driving speed for the first transporting speed A to the driving speed for the second transporting speed B. Therefore, if the recording paper 5 is long-size paper 5*a* or the like that has a long length in the direction of transport, the time period for driving the first or second driving motor 93 or 94 that is for the behind side at the driving speed for the first transporting speed A is longer than in the case of standard-size paper or the like. Such an operation of skew correction also applies to recording paper having a large basis weight, coated paper, embossed paper, and so forth.

The other configurations and functions are the same as those of the first exemplary embodiment, and description thereof is omitted.

While the above exemplary embodiments each relate to an image forming apparatus configured to form a full-color image, the application of the exemplary embodiments is not limited thereto. The above exemplary embodiments may each be applied in the same way to an image forming apparatus configured to form a monochrome image.

While the above exemplary embodiments each relate to a case where the sheet transporting device is applied to a paper transporting device intended for an image forming apparatus, the application of the sheet transporting device is not limited thereto. The sheet transporting device may be applied in the same way to a device intended for any printing apparatus or the like other than the image forming apparatus, as long as the device is configured to transport a sheet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1)))

A sheet transporting device comprising:

a skew correcting component configured to correct any skew of a sheet by executing speed-gap driving in which first and second transporting components that are arranged at respective positions in a direction intersecting a direction of sheet transport are driven for a predetermined time period with a speed gap between the first and second transporting components; and a changing component configured to change, with reference to a characteristic relevant to sheet transport, a state of the speed-gap driving of the skew correcting component.

(((2)))

The sheet transporting device according to (((1))), wherein a time period for which the speed-gap driving of the skew correcting component is to be continued is corrected with reference to an amount of skew of the sheet.

(((3)))

The sheet transporting device according to (((1))) or (((2))), wherein the state of the speed-gap driving is to be changed by changing, with reference to the characteristic relevant to sheet transport, a time period to be spent for deceleration or acceleration of each of the first and second transporting components from a first speed to a second speed.

(((4)))

The sheet transporting device according to (((1))), wherein the characteristic relevant to sheet transport to be referred to by the changing component in changing the state of the speed-gap driving includes at least one of a length of the sheet in the direction of sheet transport, a basis weight of the sheet, and a material of the sheet.

(((5)))

The sheet transporting device according to (((3))) or (((4))), wherein the changing component is configured to calculate a time period to be spent for deceleration or acceleration of each of the first and second transporting components from a first speed to a second speed and to change the time period with reference to at least one of the length of the sheet in the direction of sheet transport, the basis weight of the sheet, and the material of the sheet.

(((6)))

The sheet transporting device according to any one of (((1))) to (((5))), wherein a timing of changing a speed of transport by each of the first and second transporting components of the skew correcting component from a first speed to a second speed is to be changed with reference to an amount of skew of the sheet.

(((7)))

The sheet transporting device according to (((6))), wherein the state of the speed-gap driving is to be changed by changing, with reference to the characteristic relevant to sheet transport, the timing of changing the speed of transport by each of the first and second transporting components from the first speed to the second speed.

(((8)))

The sheet transporting device according to (((6))) or (((7))), wherein the timing of changing the speed of transport by each of the first and second transporting components from the first speed to the second speed is to be changed by the changing component with reference to the characteristic relevant to sheet transport and through multiplication of a reference value for the timing of changing the speed by an adjustment factor, the characteristic relevant to sheet transport including at least one of a length of the sheet in the direction of sheet transport and a basis weight of the sheet.

(((9)))

The sheet transporting device according to any one of (((6))) to (((8))), wherein the changing component is capable of setting the adjustment factor with reference to the characteristic relevant to sheet transport, the characteristic relevant to sheet transport including at least one of the length of the sheet in the direction of sheet transport, the basis weight of the sheet, and a material of the sheet.

(((10)))

An image forming apparatus comprising:

an image forming component configured to form an image on a sheet; and a sheet transporting component configured to transport the sheet and serving as the sheet transporting device according to any one of (((1))) to (((9))).

What is claimed is:

1. A sheet transporting device comprising:

a skew correcting component configured to correct any skew of a sheet by executing speed-gap driving in which first and second transporting components that are arranged at respective positions in a direction intersecting a direction of sheet transport are driven for a predetermined time period with a speed gap between the first and second transporting components; and a changing component configured to change, with reference to a characteristic relevant to sheet transport, a state of the speed-gap driving of the skew correcting component, wherein the characteristic relevant to sheet transport to be referred to by the changing component in changing the state of the speed-gap driving includes at least one of a length of the sheet in the direction of sheet transport, a basis weight of the sheet, and a material of the sheet.

2. The sheet transporting device according to claim 1, wherein a time period for which the speed-gap driving of the skew correcting component is to be continued is corrected with reference to an amount of skew of the sheet.

3. The sheet transporting device according to claim 2, wherein the state of the speed-gap driving is to be changed by changing, with reference to the characteristic relevant to sheet transport, a time period to be spent for deceleration or acceleration of each of the first and second transporting components from a first speed to a second speed.

4. The sheet transporting device according to claim 1, wherein the changing component is configured to calculate a time period to be spent for deceleration or acceleration of each of the first and second transporting components from a first speed to a second speed and to change the time period with reference to at least one of the length of the sheet in the direction of sheet transport, the basis weight of the sheet, and the material of the sheet.

5. The sheet transporting device according to claim 1, wherein a timing of changing a speed of transport by each of the first and second transporting components of the skew correcting component from a first speed to a second speed is to be changed with reference to an amount of skew of the sheet.

6. The sheet transporting device according to claim 5, wherein the state of the speed-gap driving is to be changed by changing, with reference to the characteristic relevant to sheet transport, the timing of changing the speed of transport by each of the first and second transporting components from the first speed to the second speed.

7. The sheet transporting device according to claim 6, wherein the timing of changing the speed of transport by each of the first and second transporting components from the first speed to the second speed is to be changed by the changing component with reference to the characteristic relevant to sheet transport and through multiplication of a reference value for the timing of changing the speed by an adjustment factor, the characteristic relevant to sheet transport including at least one of a length of the sheet in the direction of sheet transport and a basis weight of the sheet.

8. The sheet transporting device according to claim 7, wherein the changing component is capable of setting the adjustment factor with reference to the characteristic relevant to sheet transport, the characteristic relevant to sheet transport including at least one of the length of the sheet in the direction of sheet transport, the basis weight of the sheet, and a material of the sheet.

9. An image forming apparatus comprising:

an image forming component configured to form an image on a sheet; and a sheet transporting component configured to transport the sheet and serving as the sheet transporting device according to claim 1.

10. An image forming apparatus comprising:

an image forming component configured to form an image on a sheet; and a sheet transporting component configured to transport the sheet and serving as the sheet transporting device according to claim 2.

11. An image forming apparatus comprising:

an image forming component configured to form an image on a sheet; and a sheet transporting component configured to transport the sheet and serving as the sheet transporting device according to claim 3.

12. An image forming apparatus comprising:

an image forming component configured to form an image on a sheet; and a sheet transporting component configured to transport the sheet and serving as the sheet transporting device according to claim 4.

13. An image forming apparatus comprising:

an image forming component configured to form an image on a sheet; and a sheet transporting component configured to transport the sheet and serving as the sheet transporting device according to claim 5.

14. An image forming apparatus comprising:

an image forming component configured to form an image on a sheet; and a sheet transporting component configured to transport the sheet and serving as the sheet transporting device according to claim 6.

15. An image forming apparatus comprising:

an image forming component configured to form an image on a sheet; and a sheet transporting component configured to transport the sheet and serving as the sheet transporting device according to claim 7.

16. An image forming apparatus comprising:

an image forming component configured to form an image on a sheet; and a sheet transporting component configured to transport the sheet and serving as the sheet transporting device according to claim 8.

17. A sheet transporting device comprising:

skew correcting means for correcting any skew of a sheet by executing speed-gap driving in which first and second transporting means that are arranged at respective positions in a direction intersecting a direction of sheet transport are driven for a predetermined time period with a speed gap between the first and second transporting means; and changing means for changing, with reference to a characteristic relevant to sheet transport, a state of the speed-gap driving of the skew correcting means, wherein the characteristic relevant to sheet transport to be referred to by the changing means in changing the state of the speed-gap driving includes at least one of a length of the sheet in the direction of sheet transport, a basis weight of the sheet, and a material of the sheet.

* * * * *